US008079318B2

(12) United States Patent
Kasugai

(10) Patent No.: US 8,079,318 B2
(45) Date of Patent: Dec. 20, 2011

(54) SEWING MACHINE

(75) Inventor: Keisuke Kasugai, Ichinomiya (JP)

(73) Assignee: Kabushikikaisha Barudan, Ichinomiya-shi, Aichi-ken (JP)

( * ) Notice: Subject to any disclaimer, the term of this patent is extended or adjusted under 35 U.S.C. 154(b) by 466 days.

(21) Appl. No.: 12/422,645

(22) Filed: Apr. 13, 2009

(65) Prior Publication Data

US 2009/0277365 A1 Nov. 12, 2009

(30) Foreign Application Priority Data

May 7, 2008 (JP) ..... 2008-121454
May 20, 2008 (JP) ..... 2008-132234

(51) Int. Cl.
*D05B 69/00* (2006.01)

(52) U.S. Cl. ..... 112/221

(58) Field of Classification Search ..... 112/475.01, 112/288, 281, 78, 98, 128, 155, 221, 222, 112/245, 475.18, 163, 199, 202
See application file for complete search history.

(56) References Cited

U.S. PATENT DOCUMENTS 1,538,744 A * 5/1925 Ray ..... 112/157
3,450,081 A * 6/1969 Rabinow ..... 112/221
4,323,020 A * 4/1982 Thompson ..... 112/61
4,803,002 A * 2/1989 Wollenberg ..... 508/194
5,086,719 A * 2/1992 Ogawa ..... 112/225
5,653,187 A * 8/1997 Kawamoto et al. ..... 112/320
6,499,415 B1 * 12/2002 Grant et al. ..... 112/443
7,114,454 B2 * 10/2006 Block et al. ..... 112/221

FOREIGN PATENT DOCUMENTS

JP 2866488 10/1992
JP 2002-066183 3/2002

* cited by examiner

*Primary Examiner* — Tejash Patel
(74) *Attorney, Agent, or Firm* — Connolly Bove Lodge & Hutz LLP

(57) ABSTRACT

An object of the present invention is to provide a sewing machine that naturally enables performing normal sewing work, and that enables skipping a stitch during the sewing work, and furthermore, another object is to provide a sewing machine that enables causing a latching portion and an engaging device of the needle bar to be accurately engaged and disengaged when skipping the stitch during the sewing work. An operating member return spring is provided between the operating member and the frame; and the operating member return spring is formed such that, in a process that upon supplying power to the solenoid the latching portion is being driven from the engaging position to the retreated position, a spring force of the operating member return spring is not, or only weakly exerted on the operating member while the latching portion is located between the engaging position and the vicinity of a departing point where the latching portion starts to be disengaged, and that the spring force is relatively strongly exerted on the operating member while the latching portion is located between the vicinity of the departing point and the retreated position, so that resilient force is stored in the operating member return spring with the movement of the operating member.

3 Claims, 13 Drawing Sheets

(A)

(B)

(C)

(B)
1b
73
70
1b
84
77
37
35
27a
16b
28
16
27b
27
26
78
16a
L2
20
22
1c
17
13
11b
74
81

(A)
1b
73
70
75
1b
84
77
37
35
27a
16b
28
16
27b
27
26
78
16a
L2
20
22
VI
1c
17
13
11b
74
81

(A)

(B)

SEWING MACHINE

FIELD OF THE INVENTION

The present invention relates to a sewing machine, and more particularly to a sewing machine that enables skipping a stitch during the sewing work.

BACKGROUND OF THE INVENTION

Conventionally, sewing machines that enable skipping a stitch during the sewing work have been widely known. An example of those sewing machines can be found in the patented document 1. The sewing machine according to the patented document 1 has the following structure.

The sewing machine includes a needle bar, having an engaging member (engaging device) provided at an upper portion thereof and disposed so as to vertically reciprocate with respect to a head frame; and a carriage set to be driven by a main shaft and to vertically reciprocate parallel to the needle bar; and the carriage is provided with a latching element (latching portion) which is set to move between an engaging position where the latching element can be engaged with the engaging member and a retreated position where the latching element is not engaged therewith, and which is constantly subjected to a biasing force applied in a direction toward the engaging position from the retreated position, so that the latching element normally remains engaged with the engaging member of the needle bar, to thereby cause the needle bar to vertically reciprocate with the vertical reciprocating motion of the carriage.

The sewing machine also includes an operating mechanism (skipping mechanism) including a solenoid with a rotating shaft set to reciprocatively rotate and to be driven in one direction when power is supplied to the solenoid; and an engaging portion (operating member) radially spaced from the rotating shaft of the solenoid and connected to the rotating shaft of the solenoid, so as to circumferentially rotate with the rotation of the rotating shaft of the solenoid; and the engaging portion is engaged with the latching element provided on the carriage when power is supplied to the solenoid, to thereby allow the latching element to recede from the engaging position to the retreated position, and allows the latching element, when power to the solenoid is disconnected, to return to the engaging position because of biasing force applied by a spring provided inside the solenoid.

With the sewing machine thus constructed according to the patented document 1, when the carriage vertically reciprocates with the latching element of the carriage being located at the position for engagement with the engaging member of the needle bar, the needle bar is made to vertically reciprocate together with the carriage, to thereby perform the sewing work.

For skipping a stitch during such sewing work, power is supplied to the solenoid in the operating mechanism to rotate the engaging portion, thereby driving the latching element to the retreated position where the latching element is not engaged with the engaging member of the needle bar. Under such state, the vertical reciprocating motion of the carriage is not transmitted to the needle bar, and hence the stitch is skipped.

On the other hand, for returning to the normal sewing mode from the stitch-skipping mode, power to the solenoid in the operating mechanism is disconnected, so that the engaging portion rotates toward the engaging position and the latching element returns to the engaging position, and therefore the needle bar is made to vertically reciprocate with the vertical reciprocating motion of the carriage, so as to perform the normal sewing work.

Further, the sewing machines known in the art that allow skipping a stitch during the sewing work include the one disclosed in the patented document 2. The sewing machine according to the patented document 2 has the following structure.

The sewing machine includes a needle bar disposed so as to vertically reciprocate with respect to a fixed block (frame) of a machine head but constantly biased upward, and having an engaging member (engaging device) provided at an upper portion of the needle bar; a pressing roller (positioning block) of a needle bar stopper that defines an upper dead point of the needle bar; and a carriage and a lock element mounting base (carriage) set to be driven by an upper shaft (main shaft) so as to vertically reciprocate parallel to the needle bar; and the carriage is provided with a lock element (latching portion) which is set to move between an engaging position where the lock element can be engaged with the engaging member and a retreated position where the lock element is not engaged therewith, and which is constantly subjected to a biasing force applied in one direction so as to return from the retreated position to the engaging position, so that the lock element normally remains engaged with the engaging member of the needle bar, to thereby cause the needle bar to vertically reciprocate with the vertical reciprocating motion of the carriage.

Further, the lock element is made to swing by a driving mechanism (skipping mechanism) between the engaging position and the retreated position.

With the sewing machine thus constructed according to the patented document 2, when the lock element of the carriage is at the position for engagement with the engaging member of the needle bar, the needle bar is made to vertically reciprocate with the carriage, to thereby perform the sewing work.

For skipping a stitch during such sewing work, the driving mechanism causes the lock element to the retreated position so as to disengage the lock element from the engaging member of the needle bar thus allowing only the carriage to vertically reciprocate, and hence the stitch is skipped.

For returning to the normal sewing mode from the stitch-skipping mode, the driving mechanism causes the lock element to return to the engaging position thereby allowing the needle bar to vertically reciprocate with the vertical reciprocating motion of the carriage, so that the normal sewing work can be performed.

When the lock element is disengaged from the engaging member of the needle bar by moving to the retreated position in the stitch-skipping process, the upward motion of the needle bar caused by inertia can be delimited at the position corresponding to the upper dead point by the pressing roller of the needle bar stopper.

It is to be noted that the terms in the parenthesis accompanying some terms employed in the description of the patented documents 1, 2 correspond to the constituents according to the present invention having the same or equivalent function, nature, means or feature to those of the patented documents 1, 2.

[Patented document 1] Japanese Patent No. 2866488

[Patented document 2] Japanese Unexamined Patent Publication No. 2002-66183

In order to increase the speed of the vertical reciprocating motion of the needle bar (for example, 10 to 20% faster) in the sewing work including the stitch-skipping, it is necessary to cause the latching element and the engaging member of the needle bar to get mutually engaged and disengaged quicker, according to the increase in vertically reciprocating speed of the needle bar.

In the case of the sewing machine according to the patented document 1, it might be a solution to employ a larger solenoid to obtain greater driving force, to thereby cause the latching element to be more quickly disengaged from the engaging member of the needle bar. Employing a larger solenoid leads, however, to an increase in cost and is hence not advantageous.

On the other hand, to cause the latching element to return more quickly to the engaging position with the engaging member of the needle bar, it might be an option to increase the spring force of the spring inside the solenoid to thereby eliminate obstruction against the latching element returning to the engaging position with its own biasing force. However, increasing the spring force of the spring inside the solenoid inversely creates resistance against the driving force of the solenoid driving the latching element to be disengaged from the engaging member of the needle bar, thus decreasing the disengaging speed of the latching element from the engaging member of the needle bar.

Methods of causing the latching element to return more quickly to the engaging position with the engaging member of the needle bar also include increasing the spring force biasing the latching element toward the engaging position. Increasing the biasing force creates, however, greater force resisting against the driving force of the solenoid causing the latching element to be disengaged from the engaging member of the needle bar, thus leading to the disadvantage that the latching element gets disengaged from the engaging member of the needle bar at reduced speed.

Consequently, as described above, the conventional sewing machine according to the patented document 1 has the drawback that the increase in vertically reciprocating speed of the needle bar cannot be achieved, because it is impossible to increase the engaging speed nor the disengaging speed between the latching element and the engaging member of the needle bar according to the increase in vertically reciprocating speed of the needle bar.

Also, for skipping the stitch during the normal sewing work with the sewing machine according to the patented document 2, the lock element is moved to the retreated position while the carriage is moving toward the upper dead point with the needle bar, and the needle bar released from the engagement with the lock element keeps ascending at the same pace thus to collide with the pressing roller of the needle bar stopper, and the needle bar, upon once descending because of the reaction of the collision, is again driven to ascend with great force by the upward biasing force, halfway of the descending motion. Then the needle bar again collides with the pressing roller thus to be caused to descend by the reaction, but is driven upward again by the biasing force. Thus, the needle bar repeats the descending and ascending motions in the vicinity of the upper dead point, which creates the drawback that the position of the needle bar is not stabilized immediately upon reaching the upper dead point.

Since the needle bar repeats the vertical reciprocating motion even after reaching the upper dead point, and is hence not stably set at the position corresponding to the upper dead point, the lock element of the carriage cannot be accurately engaged with the engaging member of the needle bar even though the carriage ascends again after descending to thereby have the lock element get engaged with the engaging member of the needle bar at the position corresponding to the upper dead point, because the timing is too short before the needle bar starts to descend after reaching the upper dead point, and therefore only the carriage descends without being accompanied with the needle bar, which leads to failure in performing the sewing work as designed, and to create a defective embroidery pattern.

BRIEF SUMMARY OF THE INVENTION

An object of the present invention is to provide a sewing machine that naturally enables performing normal sewing work, and that enables skipping a stitch during the sewing work.

Another object is to provide a sewing machine that enables causing a latching portion and an engaging device of the needle bar to be accurately engaged and disengaged when skipping the stitch during the sewing work.

Other objects and advantages will easily become more apparent through the drawings and the following description given referring thereto.

As described above, the sewing machine according to the present invention naturally allows, when performing the sewing work, causing the needle bar 26 to vertically reciprocate with the vertical reciprocating motion of the carriage 11 when the latching portion 16 of the carriage 11 is at the position of engagement with the engaging device 27 of the needle bar 26 to thereby perform the normal sewing work, and also allows, when skipping the stitch during the normal sewing work, causing the latching portion 16 to be disengaged from the engaging device 27 of the needle bar 26, to thereby cause only the carriage 11 to vertically reciprocate thus skipping the stitch.

Further, for returning to the normal sewing work from the stitch-skipping mode, the latching portion 16 is returned to the engaging position C with the engaging device 27 of the needle bar, so as to cause the needle bar 26 to vertically reciprocate with the carriage 11, thus to perform the normal sewing work.

Also, according to the present invention, in the case of disengaging the latching portion 16 from the engaging device 27 of the needle bar 26, the operating member return spring 85 substantially does not constitute resistance, despite being provided between the operating member 78 and the frame 1, against the driving force of the solenoid 73, from immediately after supplying power to the solenoid 73 thus to start driving the operating member 78 until it reaches the vicinity of the departing point R, and therefore the entire driving force of the solenoid 73 can be employed to drive the operating member 78.

Accordingly, the operating member 78 can cause the latching portion 16 to move quickly, to get disengaged from the engaging device 27.

Further, according to the present invention, in the case of causing the latching portion 16 once disengaged to be again engaged with the engaging device 27 of the needle bar 26, the operating member 78 can be quickly returned to the engaging position C, utilizing the surplus spring force stored in the operating member return spring 85. The latching portion 16 can, therefore, be quickly returned to the engaging position C because of the biasing force applied to itself, without being disturbed by the operating member 78, to be thereby engaged with the engaging device 27 of the needle bar.

Thus, the present invention offers the advantage that the latching portion 16 can be quickly disengaged from the engaging position C with the engaging device 27 of the needle bar, and that the latching portion 16 at the retreated position S can be quickly returned to the engaging position C with the engaging device 27 of the needle bar.

This facilitates accurately engaging and disengaging the latching portion 16 and the engaging device 27 of the needle bar even though the needle bar 26 is made to vertically reciprocate faster than the conventional speed, thereby increasing the sewing speed and achieving higher sewing work efficiency.

According to the present invention, in particular, even though the surplus spring force stored in the operating member return spring 85 is employed for returning the disengaged latching portion 16 to the engaging position C with the engaging device 27, there is no likelihood that the driving force of the solenoid 73 is thereby affected at an initial stage of the disengagement of the latching portion 16 from the engaging device 27 (engagement sector T1), since the corresponding energy is acquired by accumulating the extra driving force of the solenoid 73 for the disengagement sector T2 in the operating member return spring 85, and therefore both the engagement and disengagement of the latching portion 16 and the engaging device 27 of the needle bar can be quickly performed.

Further, according to the present invention, although the latching portion 16 is disengaged from the engaging device 27 of the needle bar, while the carriage 11 is ascending toward the upper dead point accompanied by the needle bar 26 at an initial stage of the stitch-skipping action, thereby allowing the needle bar 26, now released from the engagement with the latching portion 16, to keep ascending at the same pace until colliding with the positioning block 37 at the upper dead point, and to start descending because of reaction of the collision, the second latching portion 16*b* of the carriage 11, which reaches the upper dead point after the needle bar 26, sustains the first engaging portion 27*a* of the needle bar 26 just about to start descending, thereby inhibiting the reactive motion of the needle bar 26 and thus immediately stopping the needle bar 26 at the position corresponding to the upper dead point.

Such structure allows the latching portion 16 to be accurately and smoothly engaged with the engaging device 27, because the engaging device 27 is stabilized at the predetermined position, when the carriage 11 ascends again, after once descending, so as to return the latching portion 16 to the engaging position C to be thereby engaged with the engaging device 27 of the needle bar at the position corresponding to the upper dead point, and thus allowing the carriage 11 to vertically reciprocate together with the needle bar, to thereby provide the benefit in quality that the sewing work is performed as designed so as to offer a product having a perfect embroidery pattern.

DETAILED DESCRIPTION OF THE INVENTION

Figure 1:
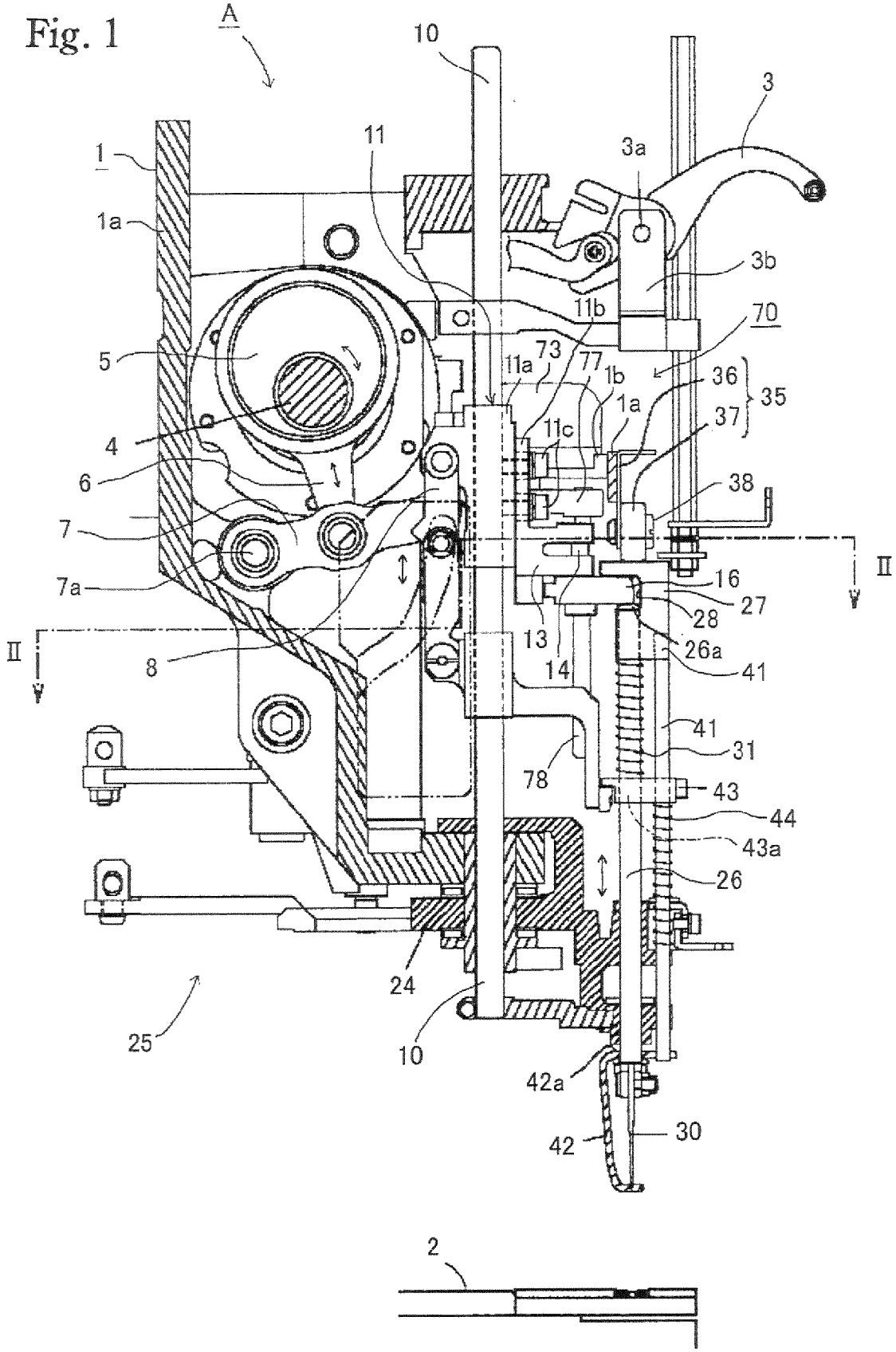
FIG. 1 is a cross-sectional view outlining a sewing machine A, and showing the state that a carriage 11 is located at the upper dead point.

Hereunder, an embodiment of the present invention will be described referring to the drawings. In FIGS. 1 and 2A to 2C, the structure involving a frame 1, a thread take-up 3, components 24 to 31 associated with a needle bar, components 35 to 38 associated with a needle bar stopper, components 41 to 44 associated with a presser foot, components 5 to 22 associated with a carriage, components associated with a skipping mechanism 70 (except those related to the description of novel technical matters (such as structure, combination or function of the components) introduced in the following description given regarding such components as a engaging device 27 of the needle bar, a second latching portion 16*b* of the carriage, and an operating member 78) represents a structure made up so as to attain similar movement and function to those of a sewing machine constituted of the components of a conventionally known model, for example the sewing machine shown in FIG. 1 of the patented document 1.

The numeral 1 designates the frame (also called a base frame) of the sewing machine A, 1*b* a second frame, removably unified with a main body 1*a* of the frame. The numeral 3 designates the thread take-up, pivotally mounted on a support shaft 3*a* supported by a thread take-up holding frame 3*b*, so as to swing up and down. The thread take-up 3 is, as publicly known, caused to swing up and down by rotation of a main shaft 4 via a thread take-up driving mechanism (not shown). The numeral 4 designates the main shaft that drives the thread take-up 3 and the needle bar 26, and is freely rotatable by a motor not included in the drawing.

The structure associated with the needle bar will now be described.

The sewing machine A according to the present invention includes the needle bar 26 disposed so as to vertically reciprocate with respect to the frame 1 but constantly biased upward, and having an engaging device 27 provided at an upper portion thereof. The engaging device 27 of the needle bar 26 includes a first engaging portion 27*a* to be located on the upper face of the latching portion 16 when engaged therewith, and a second engaging portion 27*b* to be located under the latching portion 16 when engaged, and the extension length of the first engaging portion 27*a* is longer than that of the second engaging portion 27*b*.

The foregoing structure will be described in further details.

Figure 2:
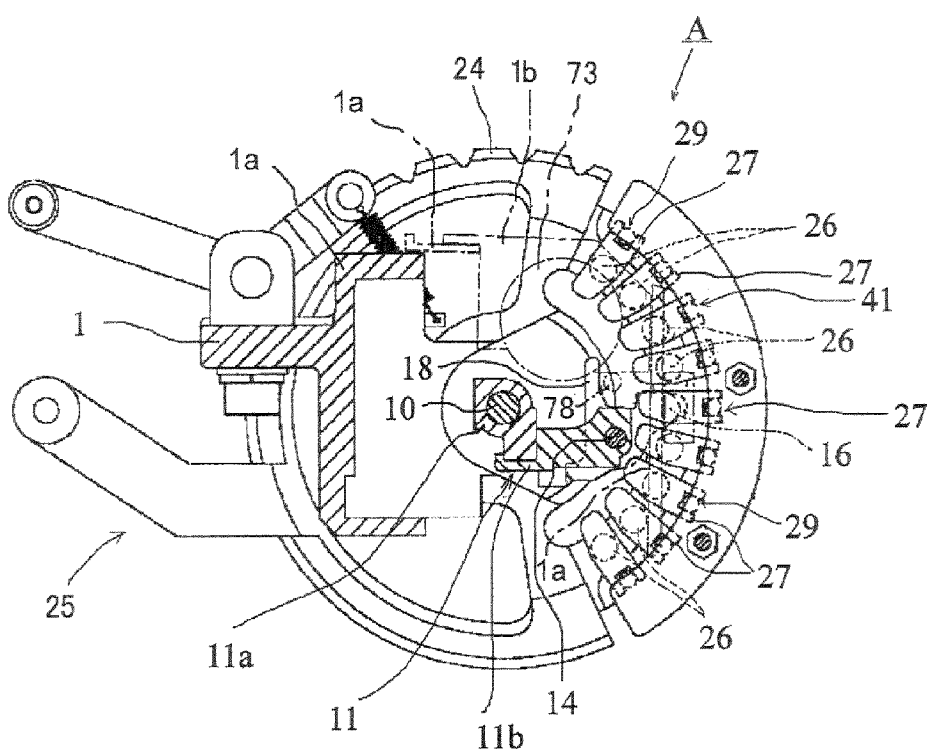
FIG. 2A is a cross-sectional view taken along a line II-II in FIG. 1.
FIGS. 2B and 2C are enlarged fragmentary plan views for explaining the relationship among an attachment 11*b* and a latching portion 16 of the carriage, a needle bar 26 and an engaging device 27 thereof in FIG. 2A, and the state that the latching portion 16 is disengaged from the engaging device 27 of the needle bar 26, respectively.
Figure 2:
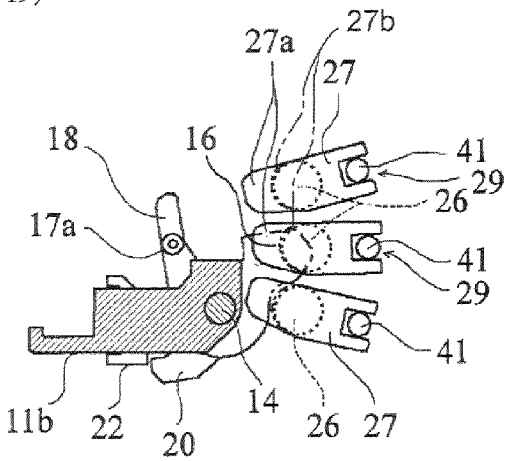
Figure 2:
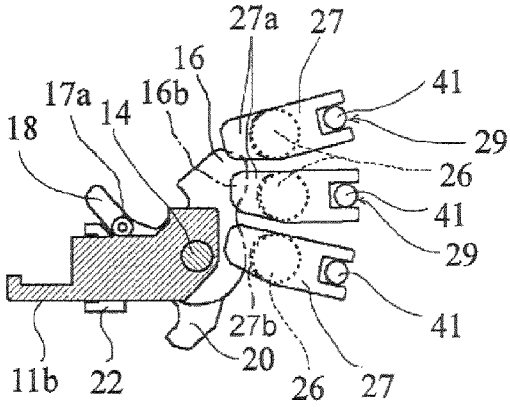

The numeral 24 in FIGS. 1 and 2A designates a needle bar holding frame to which, as popularly known, a plurality of needle bars 26 is mounted in parallel so as to vertically reciprocate, and which is reciprocatively rotatably mounted on the frame 1 so as to surround a guide bar 10 at its central portion. 25 designates a known needle bar switching mechanism, set to reciprocatively rotate about the needle bar holding frame 24 as the rotation axis (concentric with the guide bar 10). 26 designates the known needle bar, 26*a* an upper end contact interface of the needle bar 26, and 30 a needle attached to a lower portion of the needle bar 26. 27 designates an engaging device attached to an upper portion of the needle bar 26. In the engaging device 27, the extension length of a first engaging portion 27*a* shown in FIGS. 1 to 4B and 12 is longer than that of a second engaging portion 27*b*, by a difference of L2. The protruding length L2 is intended, as is apparent from the comparison between (a) and (b) to (d) in FIG. 12, to be superposed on the second latching portion 16*b* at the moment that the latching portion 16 (details will be subsequently described) is disengaged from the engaging device 27. 28 designates a recessed portion that allows the insertion and disengagement of the latching portion 16 from a lateral direction, having a vertical dimension generally the same as or slightly larger than that of the latching portion 16, for engagement substantially without a gap.

Figure 3:
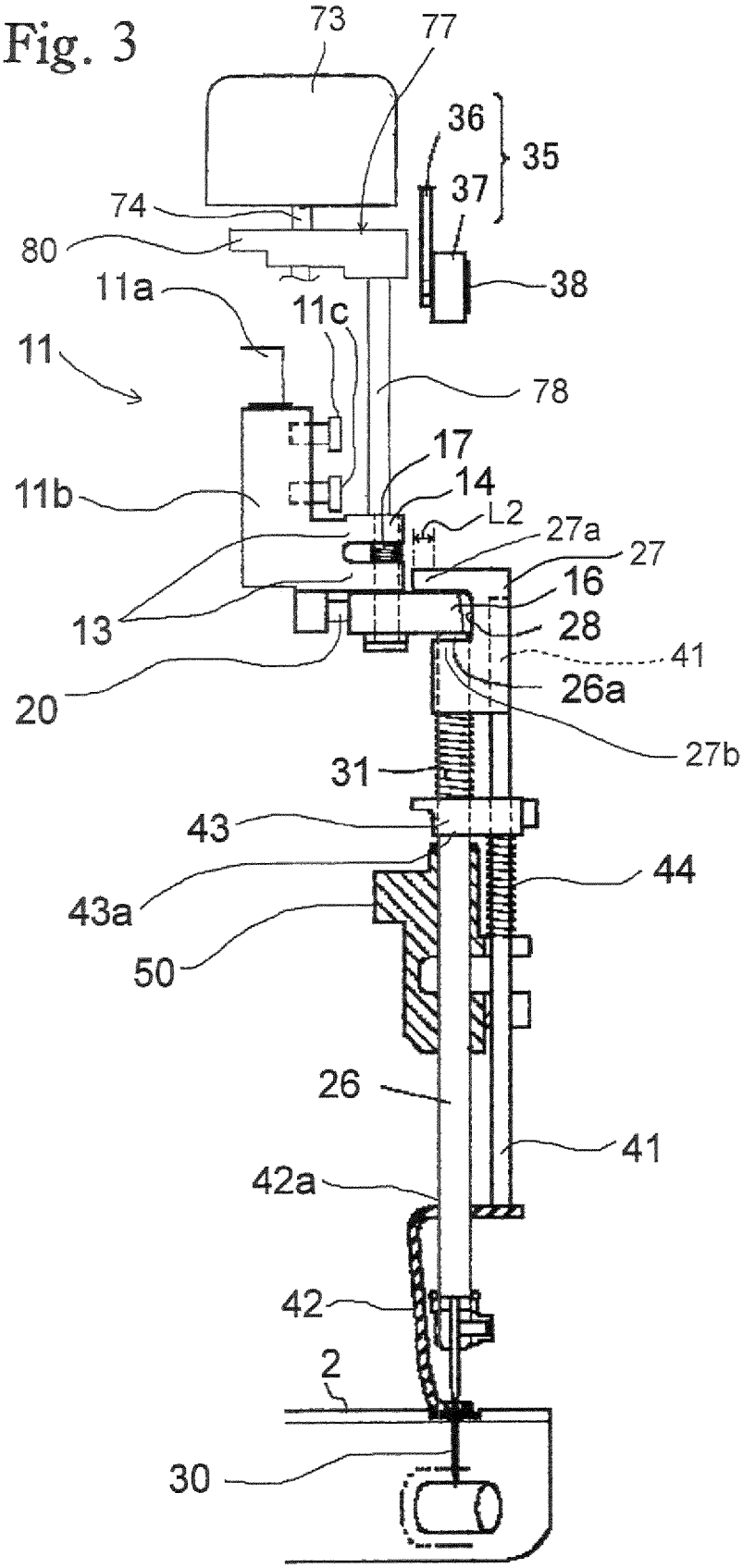
FIG. 3 is a fragmentary and simplified cross-sectional view for explaining the positional relationship among the attachment 11*b* and the latching portion 16 of the carriage 11, the needle bar 26, a presser foot and a skipping mechanism 70 in FIG. 1, showing the state that the carriage and the needle bar are located at a lower dead point.
Figure 4:
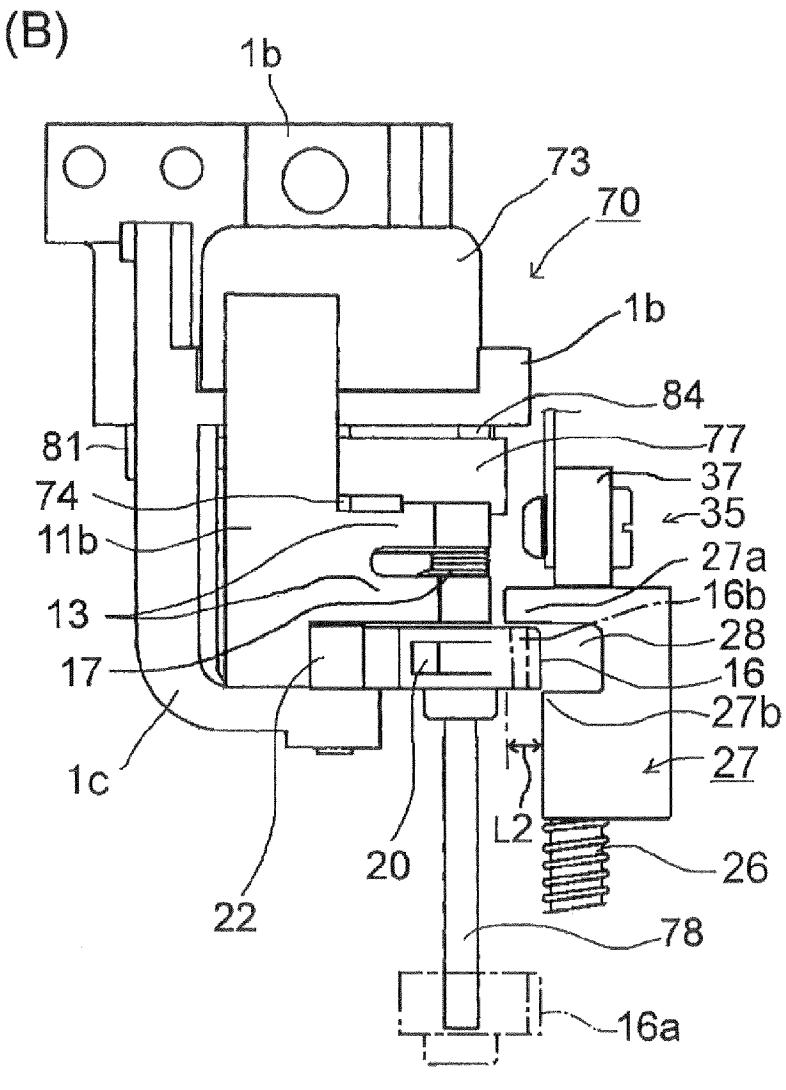
FIGS. 4A and 4B are fragmentary front views showing only a second frame, a skipping mechanism 70, the attachment 11*b* and the latching portion 16 of the carriage 11, and the engaging device 27 of the needle bar, for explaining the relationship among the skipping mechanism 70, the latching portion 16 and the engaging device 27 of the needle bar (numeral 16*a* designates the presence of the latching portion 16 at the lower dead point), and showing the state that the latching portion 16 is engaged with the engaging device 27, and the state that the latching portion 16 is not engaged with the engaging device 27, respectively.
Figure 4:
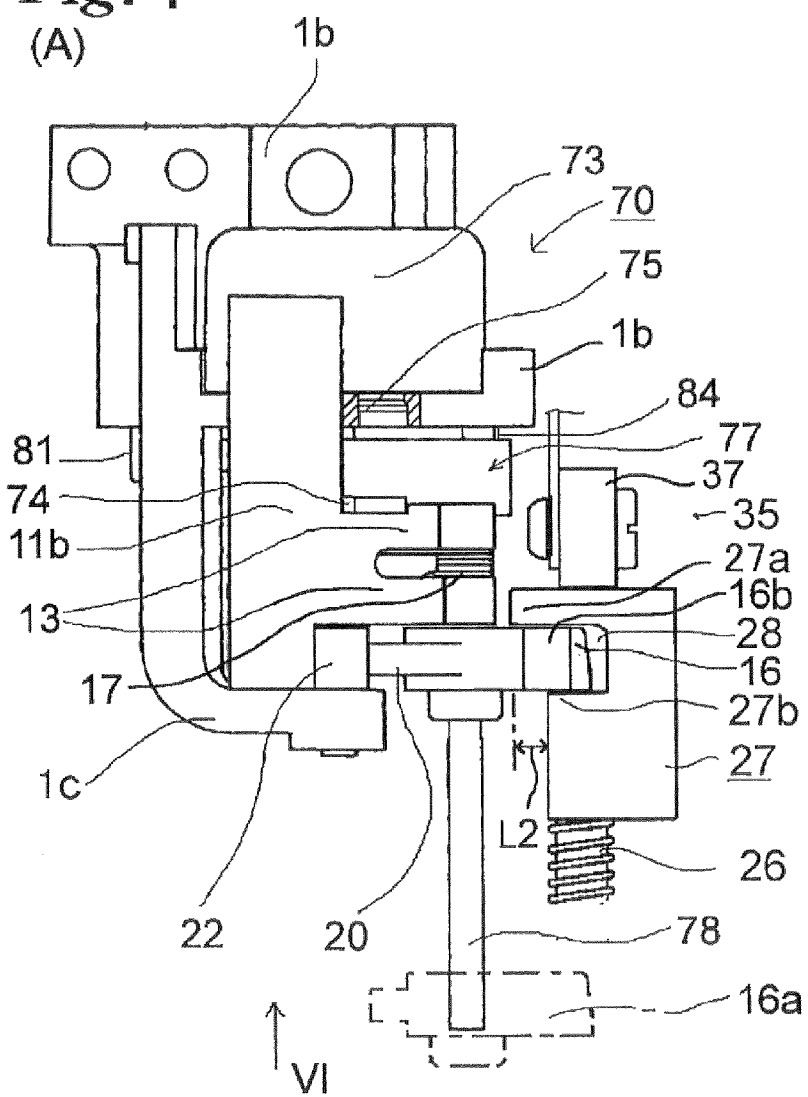
Figure 5:
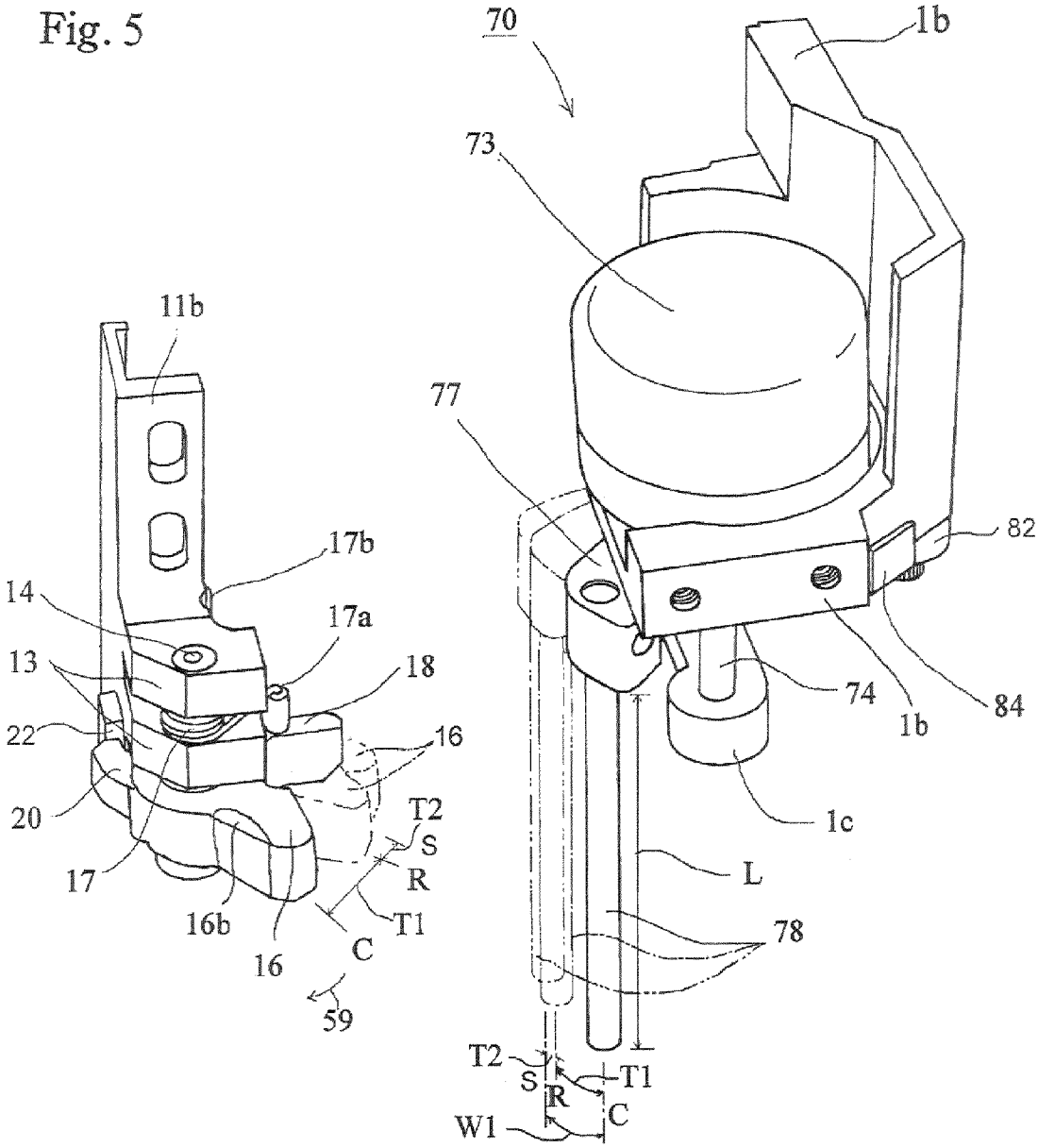
FIG. 5 is an exploded perspective view for explaining the relationship between the skipping mechanism 70 and the latching portion 16 (the skipping mechanism 70 is separated from the latching portion 16), in which solid lines indicate the position of the latching portion 16 and an operating member 78 when the latching portion 16 is at an engaging position C, and dash-dot lines the position of the latching portion 16 and an operating member 78 when the latching portion 16 is at a departing point R, and dash-dot-dot lines the position of the latching portion 16 and an operating member 78 when the latching portion 16 is at a retreated position S.

In addition, 29 designates an insertion groove that receives the upper portion of a presser bar 41 so as to vertically reciprocate with respect to the engaging device 27, and 31 in FIGS. 1 and 3 designates a compression spring.

Now, structure of a needle bar stopper will be described. Regarding the needle bar stopper 35 shown in FIGS. 1 to 4B, 36 designates a bracket attached to the main body la of the frame 1, 37 a positioning block that defines the position of the upper dead point of the needle bar 26, and attached to the bracket 37 with a fitting 38. The positioning block 37 is made of a soft elastic material such as urethane rubber, so as to mitigate noise or impact created when hit by the engaging device 27 of the needle bar which has come ascending. Here, the positioning block 37 is exemplified as being located on the axial line of the needle bar 26. However, the positioning block 37 may be located other than on the axial line of the needle bar 26 depending on the layout of the components inside the sewing machine A, for example at a lateral position of the engaging device 27. In this case, the engaging device 27 may be provided with a component projecting toward the positioning block 37 so as to be butted thereto at the position corresponding to the upper dead point, to thereby stop the needle bar 26 at the upper dead point.

Structure of the presser foot will now be described. 41 designates a presser bar set to vertically reciprocate in a direction parallel to the needle bar 26, 42 the presser foot attached to a lower portion of the presser bar 41, 43 an interlock device attached to the presser bar 41 such that the vertical position is adjustable, and 44 a compression spring. The needle bar 26 is disposed through needle bar orifices 42*a*, 43*a* formed on the presser foot 42 and the interlock device 43 respectively, so that the presser bar 41 and the presser foot 42 can vertically reciprocate relatively to the needle bar 26. It is to be noted that the spring force of the spring 31 is set stronger than that of the spring 44 so as to allow the needle bar 26 and the presser foot 42 to vertically reciprocate in synchronization, as popularly known.

Structure related to the carriage will be described here below. The sewing machine A according to the present invention includes a carriage 11 to be driven by the main shaft, and set to vertically reciprocate in a direction parallel to the needle bar 26. The carriage 11 includes the latching portion 16, which is disposed so as to move between an engaging position C where the latching portion 16 can be engaged with the engaging device 27 and a retreated position S where the latching portion 16 is not engaged therewith, and the latching portion 16 constantly subjected to a biasing force applied in a direction from the retreated position S toward the engaging position C, so that the latching portion 16 normally remains engaged with the engaging device 27 of the needle bar 26, to thereby cause the needle bar 26 to vertically reciprocate with vertical reciprocating motion of the carriage 11. Also, at a position lateral to the latching portion 16 a second latching portion 16*b* is provided so as to interlockedly move therewith, and the second latching portion 16*b* is located such that the second latching portion 16*b* lateral to the latching portion 16 comes to a position under the first engaging portion 27*a* so as to sustain the engaging device 27 thereby inhibiting the needle bar 26 from descending farther, when the latching portion 16 is moved, while the needle bar 26 is ascending, from the engaging position C toward the retreated position S until passing over the departing point R, thereby causing the needle bar 26 to keep ascending because of inertia until the engaging device 27 of the needle bar 26 collides with the positioning block 37 at the upper dead point, and to start descending because of reaction from the collision.

Further details will be described regarding the foregoing structure. The numeral 10 in FIGS. 1 and 2A designates a guide bar attached to the frame 1 parallel to the needle bar 26, and 11 the carriage attached to the guide bar 10 so as to vertically reciprocate. Referring to carriage 11, 11*a* designates the main body, and 11*b* an attachment attached to the main body 11*a* with a screw 11*c*, such that the vertical position thereof is adjustable. 13 designates an arm of the attachment 11*b*, extending toward the needle bar 26 and its distal portion is branched into two arms with a gap therebetween, as shown in FIGS. 1 to 5.

The numeral 16 in FIGS. 1 to 7B designates the latching portion, attached to the distal portion of the arm 13 so as to rotate about a pivotal shaft 14. The rotation range of the latching portion 16 extends, as shown in FIGS. 5 to 7B, from the engaging position C to the retreated position S via the departing point R, where the latching portion 16 can reciprocatively rotate. 17 in FIGS. 4A to 5 designates a latching portion return spring that constantly biases the latching portion 16 in a direction toward the engaging position C from the retreated position S (direction of arrow 59 in FIG. 5), and is a coil spring. The latching portion return spring 17 is located in the gap of the arm 13 and around the outer circumference of the pivotal shaft 14, as is apparent from the drawings, with an end portion engaged with a spring stopper 17*a* and the other end portion with a spring stopper 17*b*. 18 designates an operating arm to be engaged with an operating member 78 for causing the latching portion 16 to recede from the engaging position C to the retreated position S, and integrally formed with the latching portion 16. 20 designates a stopper-engaging protrusion that delimits the movement of the latching portion 16 at the engaging position C, formed to be butted to a stopper 22 provided on the attachment 11*b* at a position shown in FIGS. 5 and 6.

Now, the second latching portion 16*b* shown in FIGS. 1 to 5 and FIG. 12 is integrally formed with the latching portion 16 and located lateral thereto. The vertical dimension of the second latching portion 16*b* is the same as that of the latching portion 16, and the second latching portion 16*b* is reciprocatively movable between the position depicted as (a) in FIG. 12 and the position depicted as (d) in FIG. 12. The second latching portion 16*b* is located, as is understood from FIGS. 2B, 2C and 12, so as to overlap the lower face of the first engaging portion 27*a* under the state that the latching portion 16 is disengaged from the engaging device 27 (sector T2 between the departing point R and the retreated position S). More strictly, the second latching portion 16*b* is located so as to overlap the lower face of the first engaging portion 27*a* under the state shown in (d) in FIG. 12. Practically, however, numerous different designs are made in various aspects such as vertical travelling speed of the carriage 11, speed of the needle bar 26 ascending by inertia, resilience of the positioning block 37, timing of disengagement of the latching portion 16 from the engaging device 27, and also in vertical dimension of the first engaging portion 27*a*, and therefore the second latching portion 16*b* may be located, taking such factors into consideration, at an appropriate position in the vicinity of the position corresponding to (d) in FIG. 12 according to the actual situation, for example so as to overlap the lower face of the first engaging portion 27*a* slightly before or after the state of (d) in FIG. 12.

Figure 12:
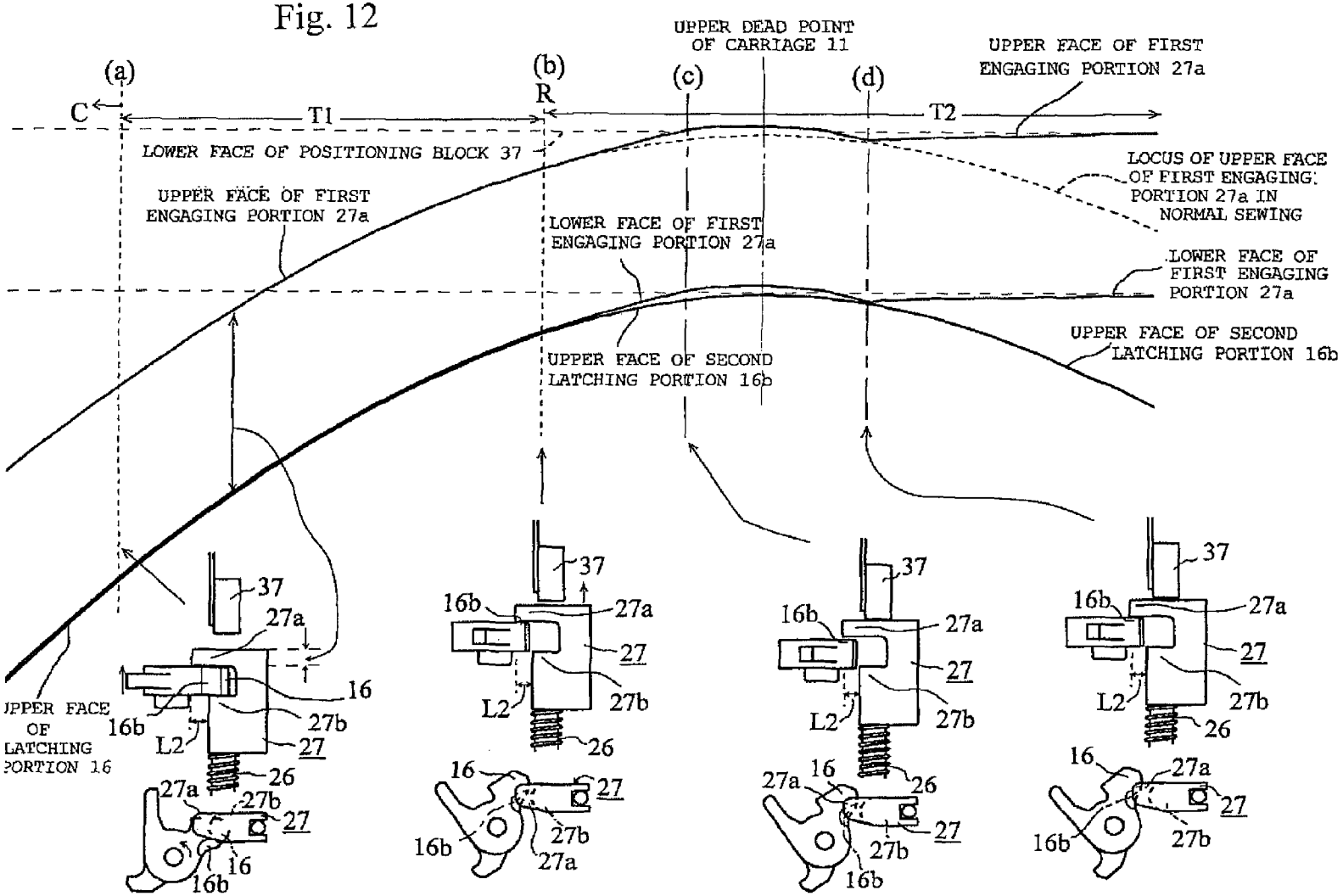
FIG. 12 is a schematic diagram indicating in enlarged curves the movement of the first engaging portion 27*a*, the second latching portion 16*b*, and the positioning block 37 corresponding to the segment XII in FIG. 8, for further clarifying the positional relationship among those parts, and also includes lateral views and plan views under the diagram, which are associated with the first engaging portion 27*a*, the second latching portion 16*b* and the positioning block 37 at the respective time points (a) to (d) in the diagram.
Figure 13:
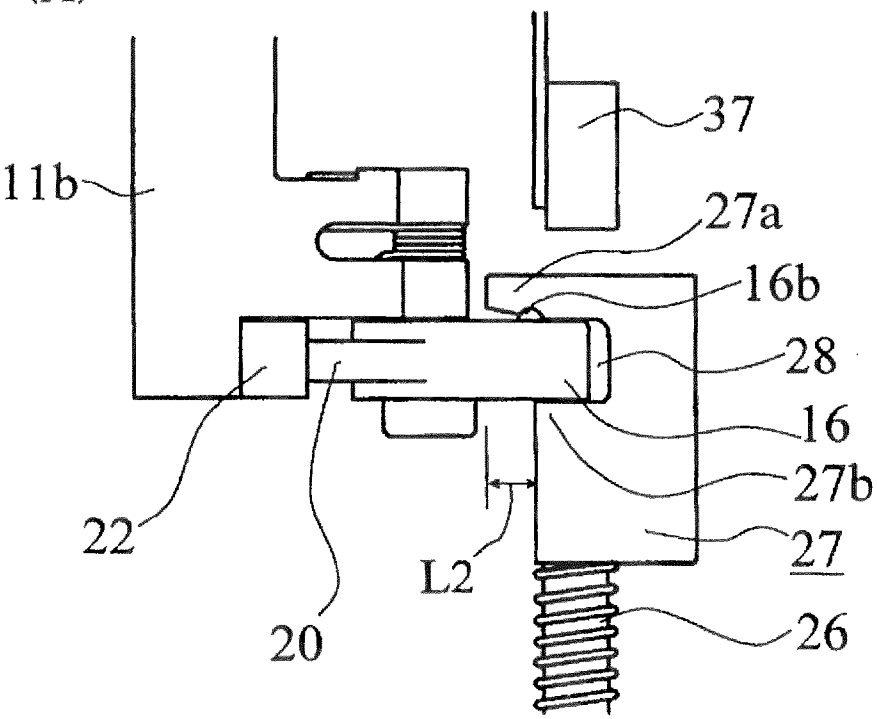
FIGS. 13A and 13B are lateral views for explaining different examples of the vertical positional relationship between the upper face of the second latching portion 16*b* and the lower face of the first engaging portion 27*a*, the former showing the state that the latching portion 16 is at the engaging position C, and the latter showing the state that the second latching portion 16*b* is located under the first engaging portion 27*a*.
Figure 13:
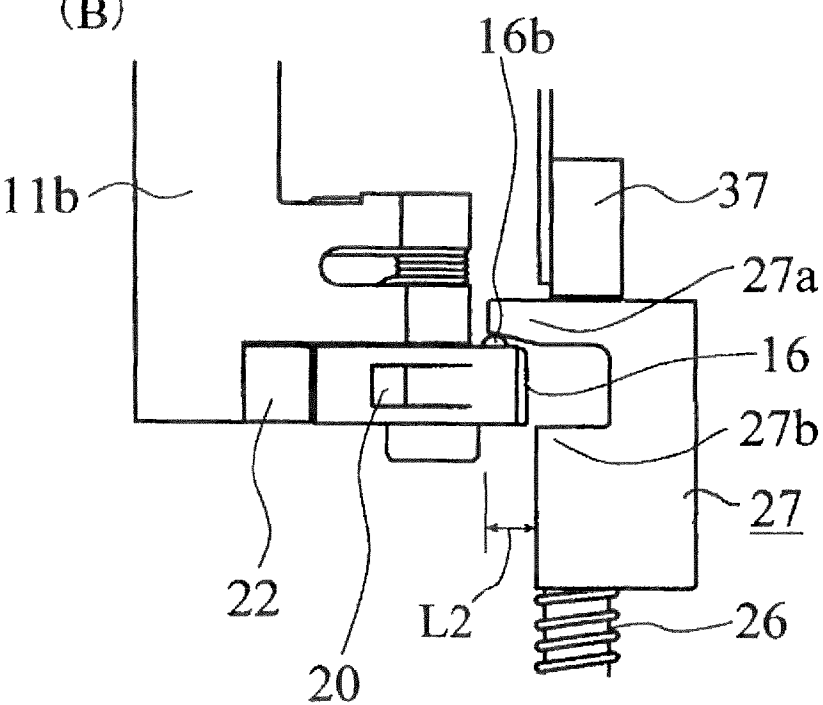

The vertical positional relationship between the upper face of the second latching portion 16*b* and the lower face of the first engaging portion 27*a* may be relatively adjusted. For example, in the case where the cross-sectional shape of the distal portion of the first engaging portion 27*a* of the engaging device 27 has a shape as shown in FIGS. 13A and 13B and the lower face of the first engaging portion 27*a* is at a higher position than as shown in FIGS. 1 to 12, the second latching portion 16*b* may be formed so as to protrude from the upper face of the latching portion 16, as shown in FIGS. 13A and 13B. In this case, when the engaging device 27 of the needle bar is about to descend because of the reaction from the collision with the positioning block 37, the second latching portion 16*b* can be located under the first engaging portion 27*a* thus to sustain the engaging device 27 as shown in FIG. 13B, thereby inhibiting the needle bar 26 from descending.

Also, the second latching portion 16*b* may be separately formed from the latching portion 16 and then be unified therewith so as to move interlockedly.

Now, the mechanism that drives the carriage 11 to vertically reciprocate will be described below. A known mechanism may be employed for this purpose, and for example a crank mechanism constituted of the components designated by the numerals 5 to 8 in FIG. 1 may be employed. The numeral 5 designates a cam fixed to the main shaft 4, 6 a crank rod, 7 a lever attached to the frame 1 via a pivotal shaft 7*a*, and 8 a link connecting the free end of the lever 7 and the carriage 11. Rotation of the main shaft 4 causes the link 8 to vertically reciprocate via the components 5 to 7, thus also causing the carriage 11 to vertically reciprocate with respect to the guide bar 10.

Figure 8:
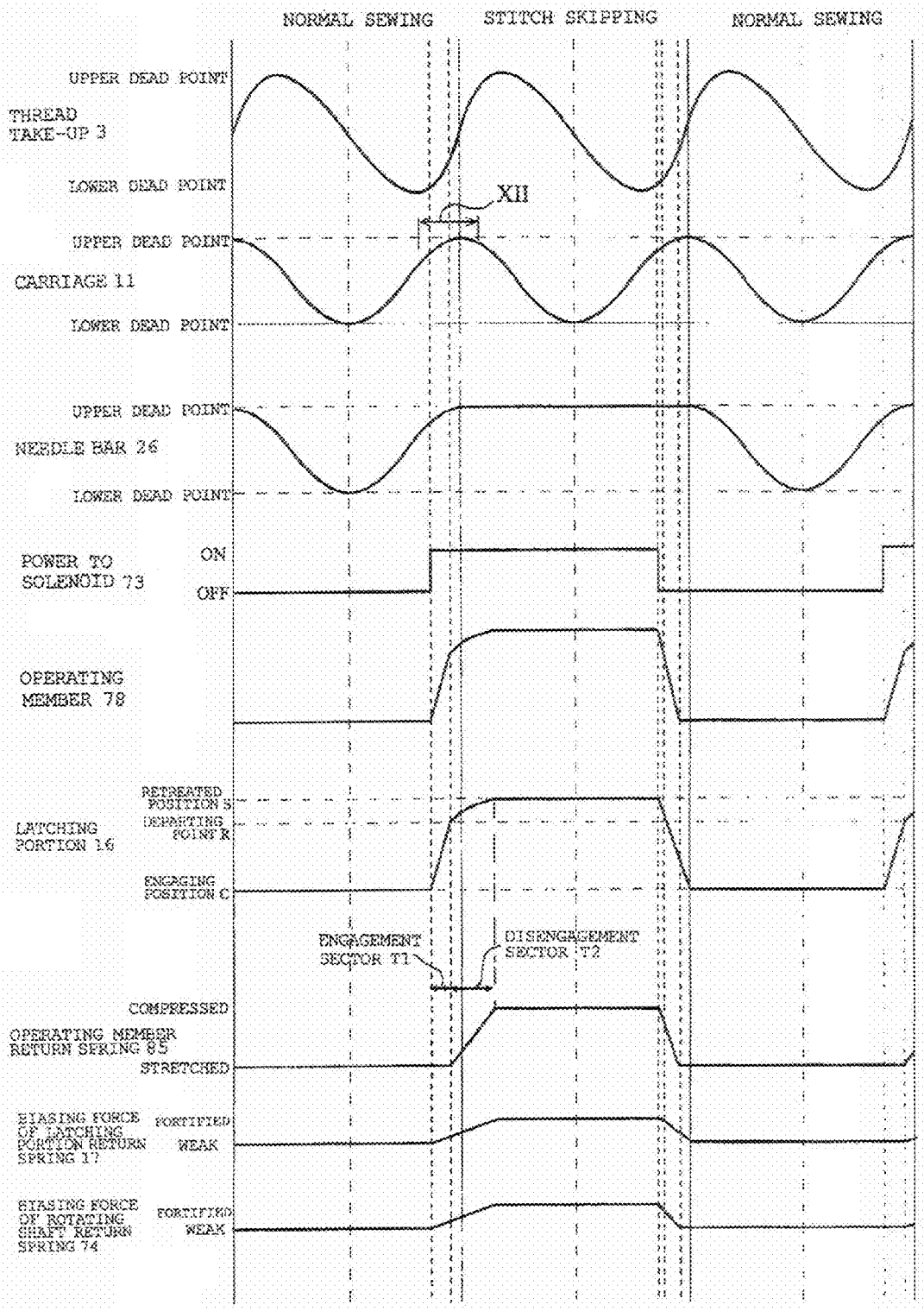
FIG. 8 is a chart for explaining an operational relationship among a thread take-up 3, the carriage 11, the needle bar 26, the latching portion 16, a solenoid 73 in the skipping mechanism, the operating member 78, the operating member return spring 85 in the preceding drawings, and so on of the sewing machine A, indicating the movement of the respective parts corresponding to three times of rotations of the main shaft, in the case where the normal sewing work and stitch-skipping action are alternated at every stitch.
Figure 9:
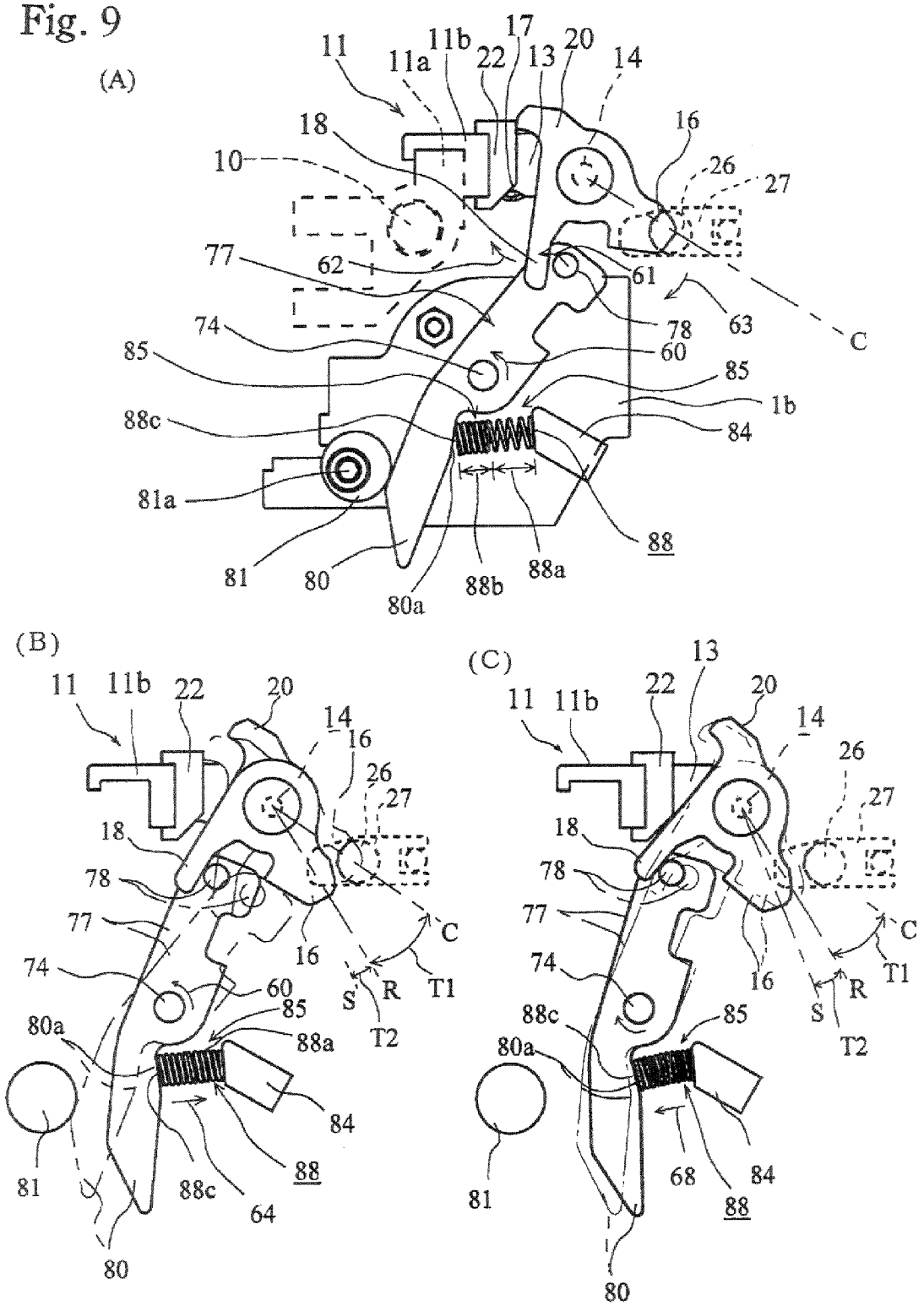
FIGS. 9A to 9C are simplified plan views from the same direction as FIG. 6 for explaining different examples of the operating member return spring 85, showing the state that the latching portion 16 is at the engaging position C, the state that the latching portion 16 is at the departing point R, in which dash-dot lines designate the presence of the latching portion 16 and the rotating arm 77 at the engaging position C, and the state that the latching portion 16 is at the retreated position S, in which dash-dot lines designate the presence of the latching portion 16 and the rotating arm 77 at the departing point R, respectively.
Figure 10:
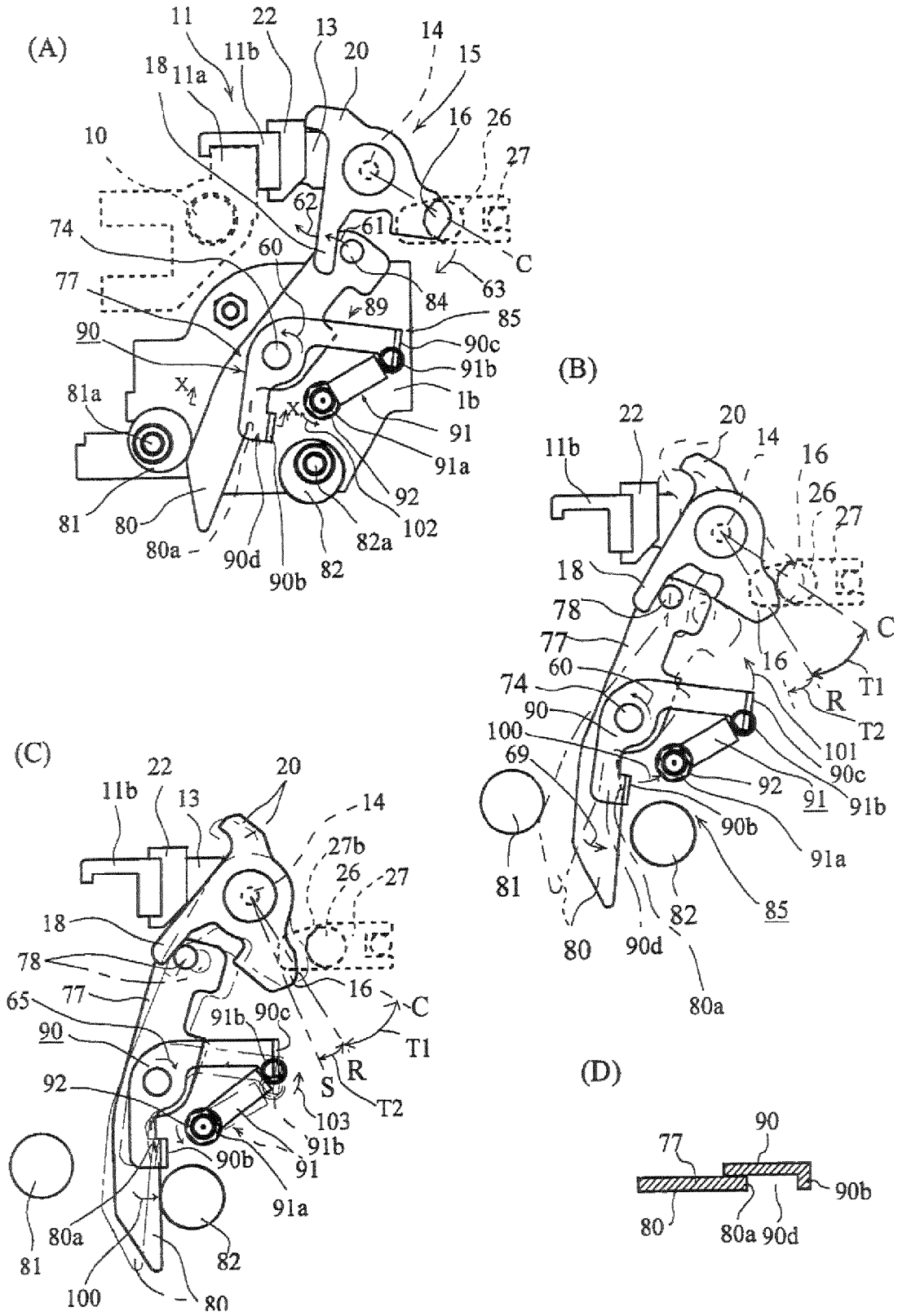
FIGS. 10A to 10C are simplified plan views from the same direction as FIG. 6 for explaining different examples of the operating member return spring 85, showing the state that the latching portion 16 is at the engaging position C, the state that the latching portion 16 is at the departing point R, in which dash-dot lines designate the presence of the latching portion 16 and the rotating arm 77 at the engaging position C, and the state that the latching portion 16 is at the retreated position S, in which dash-dot lines designate the presence of the latching portion 16 and the rotating arm 77 at the departing point R, respectively.
FIG. 10D is a fragmentary cross-sectional view taken along a line X-X in FIG. 10A, for explaining the positional relationship between an extension for stopper 80 and a receiving portion 90*b* of a pivoting piece 90.
Figure 11:
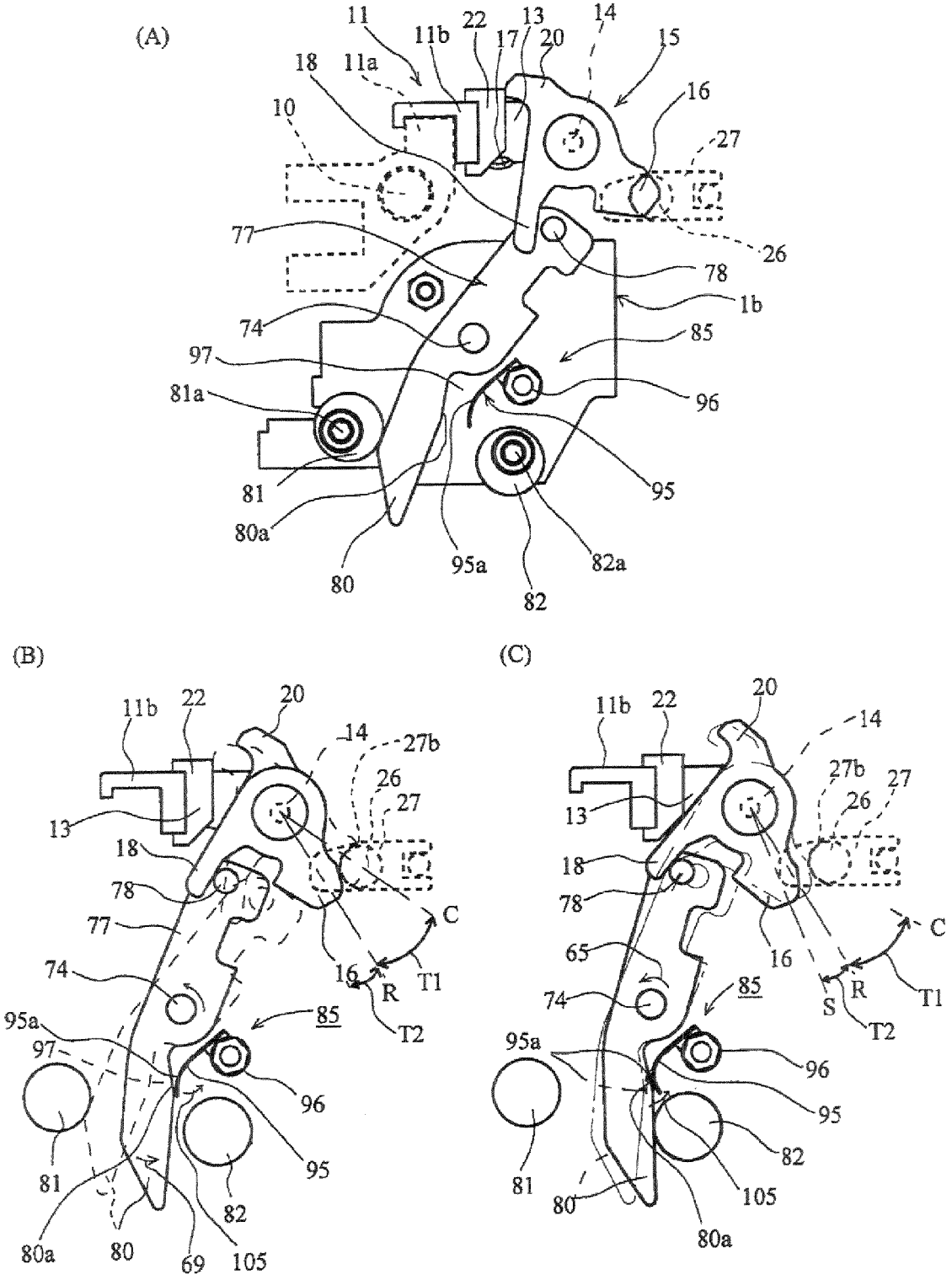
FIGS. 11A to 11C are simplified plan views from the same direction as FIG. 6 for explaining different examples of the operating member return spring 85, showing the state that the latching portion 16 is at the engaging position C, the state that the latching portion 16 is at the departing point R, in which dash-dot lines designate the presence of the latching portion 16 and the rotating arm 77 at the engaging position C, and the state that the latching portion 16 is at the retreated position S, in which dash-dot lines designate the presence of the latching portion 16 and the rotating arm 77 at the departing point R, respectively.

In this case, further, it is appropriate to synchronize the carriage 11, the needle bar 26, the presser foot 42, the thread take-up 3 and so forth (so as to perform translational actions as shown in FIG. 8) for performing the sewing work, as popularly known.

Structure associated with the skipping mechanism 70 will now be described. The skipping mechanism 70 of the sewing machine according to the present invention includes, as is apparent from FIGS. 1 and 4A to 8, a solenoid 73 with a rotating shaft 74 set to reciprocatively rotate and to be driven in one direction when power is supplied, and an operating member 78 radially spaced from the rotating shaft 74 of the solenoid 73 and connected to the rotating shaft 74 of the solenoid 73, so as to circumferentially rotate with the rotation of the rotating shaft 74 of the solenoid 73, and the operating member 78 is engaged, when power is supplied to the solenoid, with the latching portion 16 provided on the carriage 11 to thereby cause the latching portion 16 to recede from the engaging position C to the retreated position S, and allows the latching portion 16 to return to the engaging position C when the power to the solenoid is disconnected.

Figure 6:
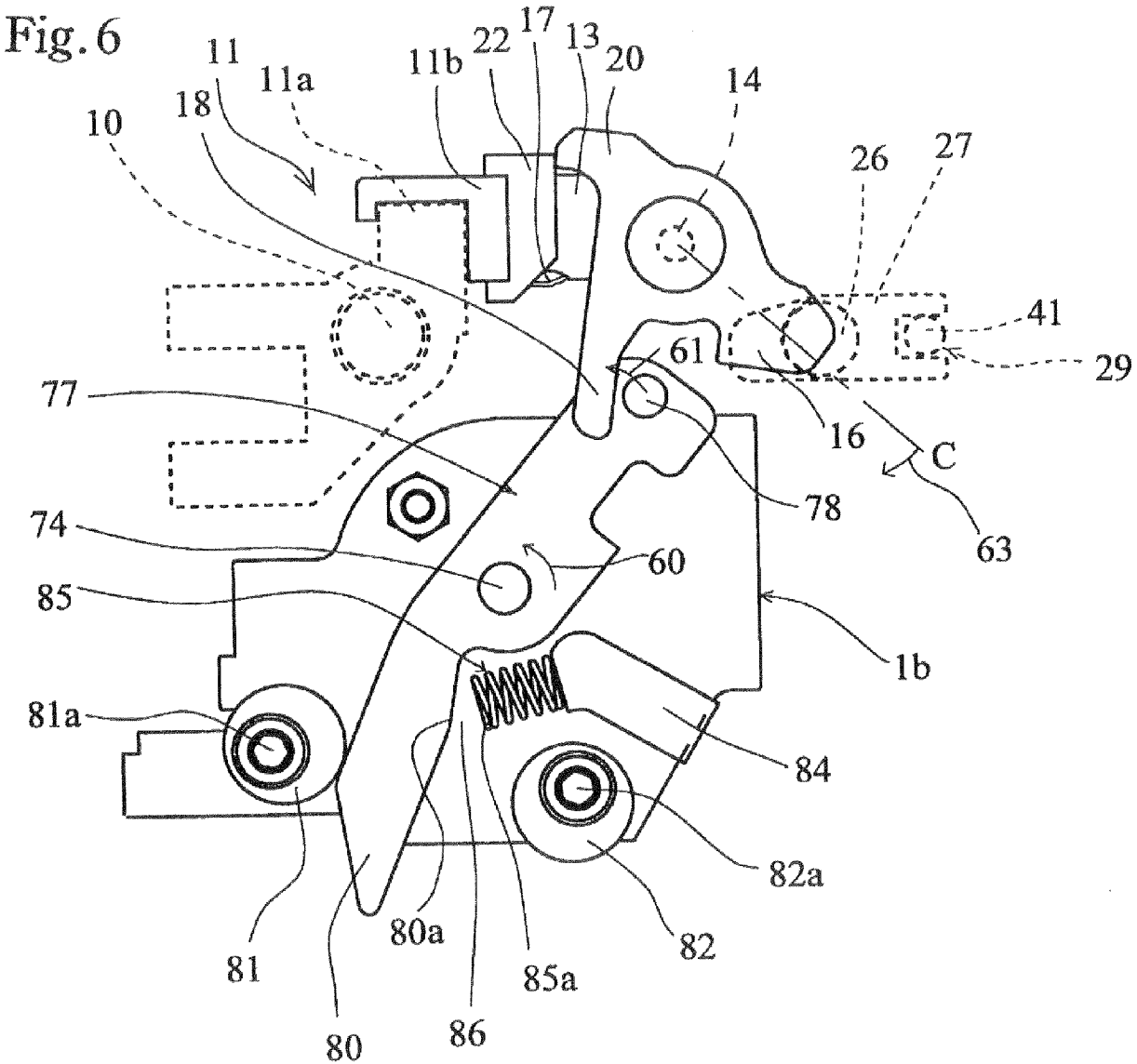
FIG. 6 is a plan view from a direction indicated by an arrow VI in FIG. 4, showing the state that the latching portion 16 is at the engaging position C, in which an extension arm 1*c* of a second frame 1*b* is excluded, and the needle bar 26, the engaging device 27, a guide bar 10 and a main body 11*a* of the carriage are indicated by broken lines.
Figure 7:
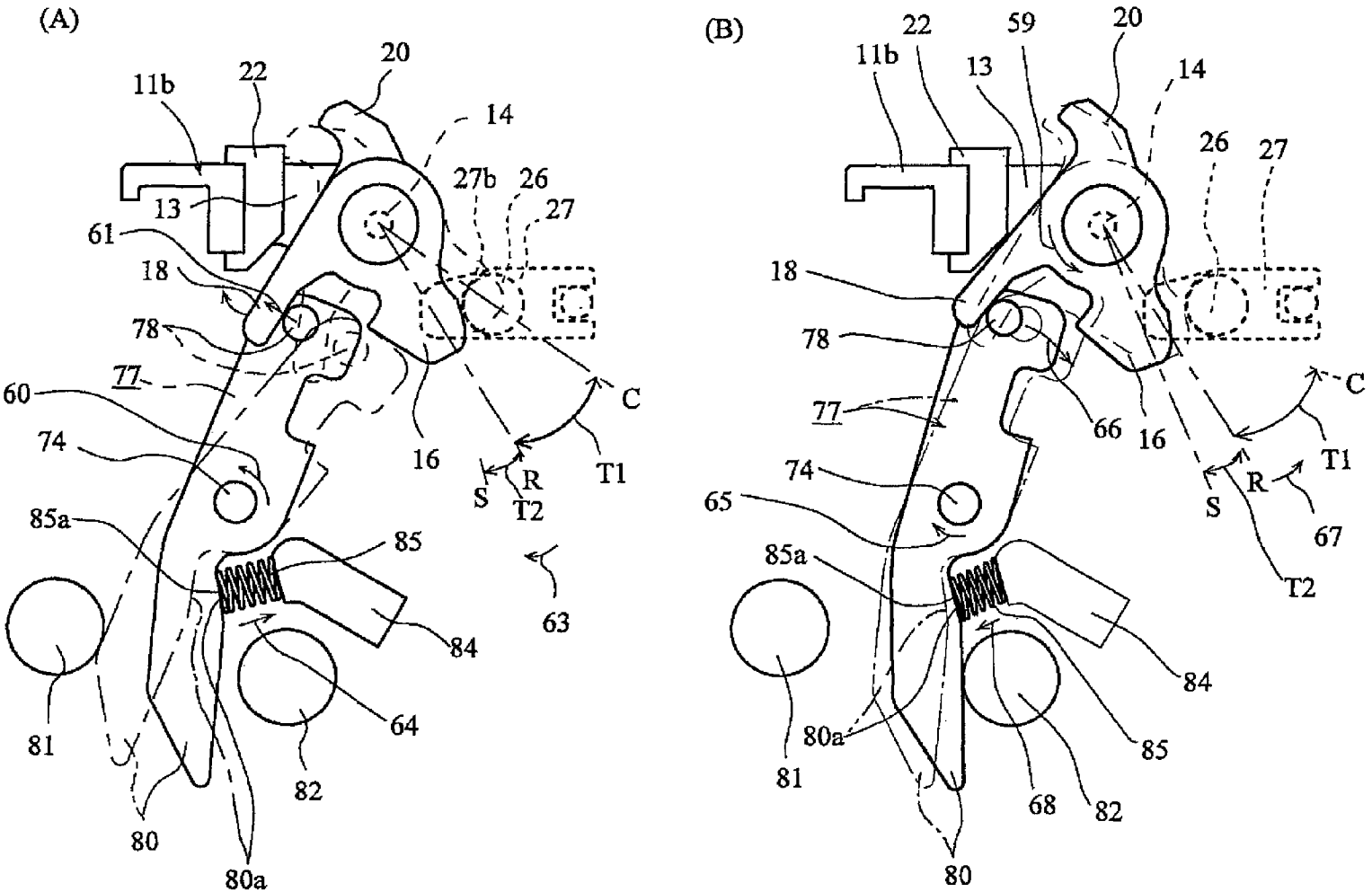
FIGS. 7A and 7B are simplified plan views for explaining an operation of the latching portion 16, the operating member 78, and an operating member return spring 85 in FIG. 6; the former showing the state that the latching portion 16 is at the departing point R, in which dash-dot lines designate the presence of the latching portion 16 and a rotating arm 77 at the engaging position C, and the latter showing the state that the latching portion 16 is at the retreated position S, in which dash-dot lines designate the presence of the latching portion 16 and the rotating arm 77 at the departing point R.

Further details regarding the foregoing structure will be described below. As shown in FIGS. 1, 2A, 2B and 4A to 7, the skipping mechanism 70 includes the solenoid 73, a rotating arm 77, the operating member 78, stoppers 81, 82, and an operating member return spring 85. 73 designates the solenoid, which is fixed to a second frame 1*b* joined to the frame main body 1*a* as illustrated. 77 designates the rotating arm attached to the rotating shaft 74 of the solenoid, and 78 the bar-shaped operating member attached to the distal end portion of the rotating arm 77. As is apparent from FIGS. 1, 4A and 4B, the operating member 78 has a certain length and extends parallel to the needle bar 26. The length L of the operating member 78 should be sufficient to be directly butted to the operating arm 18 of the carriage 11 when the carriage 11 is at the lower dead point, and to guide the vertical reciprocating stroke of the operating arm 18 in the case where the operating arm 18 contacts the operating member 78 while the latching portion 16 is vertically moving. As shown in FIGS. 5 to 8, the rotation range (stroke W1) of the operating member 78 is widely provided so as to allow the latching portion 16 to rotate from the engaging position C with the engaging device 27 to the departing point R where the latching portion 16 starts to be disengaged from the engaging device 27, and further to reach the retreated position S from the departing point R. 80 designates an extension for stopper formed on the rotating arm 77, and 81, 82 the stoppers fixed to a second frame 1*b* with a bolt 81*a*, 82*a* respectively. The stoppers 81, 82 serve to delimit the rotation range of the rotating arm 77, in a manner as shown in FIGS. 6 and 7B. Thus, naturally, the rotation range (stroke W1) of the operating member 78 is delimited. The stoppers 81, 82 may be formed of a soft material (rubber or soft resin) such as urethane rubber or an elastomer, as the case may be. Such material serves to mitigate noise or impact that may be incurred upon being hit by the extension for stopper 80.

The solenoid 73 causes the rotating shaft 74 to rotate in a direction indicated by the arrow 60 in FIG. 6 when power is supplied to the coil provided inside the solenoid, and disconnecting the power to the solenoid 73 allows, as is apparent, the rotating shaft 74 to return to the initial position driven by the rotating shaft return spring 75 provided inside the solenoid.

Further, although according to the drawings the main body 1*a* of the first frame 1 and the second frame 1*b* are separately formed and then unified to build up the frame 1, these two components may be integrally formed as a single piece and the skipping mechanism 70 may be directly mounted on the frame 1.

The skipping mechanism 70 of the sewing machine A according to the present invention includes the operating member return spring 85 between the operating member 78 and the frame 1, as shown in FIGS. 6 and 7A, 7B. The operating member return spring 85 and the operating member 78 are arranged such that, in the process that upon supplying power to the solenoid 73 the operating member 78 is moving the latching portion 16 from the engaging position C to the retreated position S, the spring force is not, or only weakly exerted on the operating member 78 while the latching portion 16 is located between the engaging position C and the vicinity of the departing point R where the latching portion 16 starts to be disengaged, and that the spring force is relatively strongly exerted on the operating member 78 while the latching portion 16 is located between the vicinity of the departing point R and the retreated position S, so that resilient force is stored in the operating member return spring 85 with the movement of the operating member 78.

The foregoing arrangement will be described in further details. The operating member return spring 85 is constituted of a compression spring, for example shown in FIGS. 6 and 7A, 7B, an end portion of which is fixed to the frame 1. More specifically, the operating member return spring 85 is attached to a spring base 84 provided on the second frame 1*b* constituting a part of the frame 1. The operating member return spring 85 is arranged, as illustrated, such that a gap 86 is defined between the extension for stopper 80, connected and unified with the operating member 78, and the free end 85*a* of the spring (Ref. FIG. 6). The size of the gap 86 may be determined such that the operating member 78 can remain substantially free from the effect of the operating member return spring 85 while the operating member 78 is rotating so as to cause the latching portion 16 to move from the engaging position C to the departing point R (engagement sector T1). For example, as shown in FIG. 7A, the size may be determined such that the extension for stopper 80 is butted to the free end 85*a* of the operating member return spring 85 when the latching portion 16 is about to be disengaged from the engaging device 27, i.e. in the vicinity of the departing point R. It is to be noted that, although the departing point R corresponds, if strictly defined, to the state shown in FIG. 7A, in a practical application there are various different cases regarding the level of the driving force of the solenoid 73, the inertia of the rotating arm 77, and the vertical travelling speed of the carriage 11. The reference position may, therefore, be appropriately determined in the vicinity of the departing point R according to the actual design, taking those factors in consideration, for example such that the spring force of the operating member return spring 85 is exerted on the operating member 78 immediately before the latching portion 16 is separated from the engaging device 27, or after the latching portion 16 is separated from the engaging device 27.

In addition, the operating member return spring 85 may be configured as shown in FIGS. 9A to 11C to be referred to later.

FIG. 8 shows the status of the associated actions of the thread take-up 3, the carriage 11, the needle bar 26, and the solenoid, the operating member 78, the latching portion 16, and the operating member return spring 85 of the skipping mechanism, and so on. These actions may be executed under computer control as popularly known, employing a control unit (not shown).

Operation of a normal sewing work performed with the foregoing structure will now be described.

Power to the solenoid 73 is disconnected, and the latching portion 16 is at the engaging position C shown in FIGS. 1 and 6. When the main shaft 4 rotates under such state, the carriage 11 vertically reciprocates as described earlier, and the needle bar 26 also vertically reciprocates as shown in FIGS. 1, 3, and 8, thereby performing the normal sewing work.

Detailed description will be made below regarding the movement associated with the needle bar 26, during a process that the carriage 11 moves from the upper dead point to the lower dead point and again returns to the upper dead point. As is understood from FIGS. 1, 3, and 8, when the carriage 11 descends the latching portion 16 presses the second engaging portion 27*b* of the engaging device, to thereby cause the needle bar 26 to descend. At this moment, the interlock device 43 is pressed downward via the spring 31, so that the presser bar 41 and the presser foot 42 descend compressing the spring 44. When the presser foot 42 is butted to a cloth (not shown) on the upper surface of the bed 2, the components 41 to 43 stop descending. Then the carriage 11 descends further thereby causing the needle bar to descend compressing the spring 31, until the carriage 11 and the needle bar 26 reach the lower dead point as shown in FIG. 3. Thereafter, when the carriage 11 ascends the needle bar 26 also ascends so as to follow the upward movement of the carriage 11, because of the spring force of the spring 31. After the needle 30 is drawn out from the cloth, the components 41 to 43 also ascend and the needle bar 26 ascends to reach the upper dead point, because of the spring force of the springs 31, 44.

Now, operation of skipping the stitch during the normal sewing work will be described, referring to FIGS. 6 to 8, and 12. However, details of the movement of the needle bar 26, made after the latching portion 16 is disengaged and until it is delimited at the position corresponding to the upper dead point in the initial stage of the stitch-skipping action, will be described later.

As is usually the case, power is supplied to the solenoid 73 while the carriage 11 is ascending, and the rotating shaft 74 starts rotating in the direction of the arrow 60 in FIG. 6. This causes the operating member 78 to move about the rotating shaft 74 in the direction of the arrow 61, to thereby press the operating arm 18. Then the latching portion 16 is driven to the disengaging direction 63, until reaching the departing point R as shown in FIG. 7A. As is understood from FIG. 7A, the latching portion 16 is disengaged, upon reaching the departing point R, from the second engaging portion 27*b* of the engaging device 27 of the needle bar.

During the movement from the engaging position C to the departing point R (engagement sector T1), the operating member 78 is substantially free from the effect of the operating member return spring 85, as shown in FIG. 8. Accordingly, the solenoid 73 can drive the operating member 78 with its fullest driving force, free from the obstruction of the operating member return spring 85, to thereby quickly move the latching portion 16 to the departing point R.

After the latching portion 16 is disengaged from the engaging device 27 of the needle bar, the rotating shaft 74 of the solenoid still keeps rotating, so as to cause the operating member 78 to keep moving in the direction of the arrow 61 in FIG. 7A, until the extension for stopper 80 is butted to the stopper 82 at the position indicated by solid lines in FIG. 7B, where the operating member 78 stops. Such movement of the operating member 78 causes the latching portion 16 to recede from the position indicated by dash-dot lines in FIG. 7B (departing point R) to the position indicated by solid lines (retreated position S). As shown in FIG. 8, the carriage 11 reaches the upper dead point and then starts descending, while the latching portion 16 is moving from the departing point R to the retreated position S (disengagement sector T2). Under such state, the latching portion 16 is not engaged with the engaging device of the needle bar 26, and hence the needle bar 26 remains at the upper dead point when the carriage 11 descends again, and the carriage 11 is descending alone. Therefore the sewing action is not performed and the stitch is skipped.

In the moving process of the operating member 78, the operating member 78 additionally moves to the retreated position S driven by the rotational force of the solenoid 73, even after reaching the departing point R where the latching portion 16 is made to be disengaged from the engaging device 27 of the needle bar. As a result, the extension for stopper 80 unifiedly connected to the operating member 78 also moves through the disengagement sector T2 (sector between the position indicated by dash-dot lines and the position indicated by solid lines in FIG. 7B), so as to compress the operating member return spring 85 at a contact interface 80*a*. Accordingly, the surplus driving force of the solenoid 73 (not involved in disengaging the latching portion 16 from the engaging device 27) can be abundantly stored in the operating member return spring 85 as resilient force, through the disengagement sector T2.

Meanwhile, since the extension for stopper 80 compresses the operating member return spring 85 while moving through the disengagement sector T2, the moving speed becomes slower compared with the speed in the engagement sector T1. This contributes to mitigating the noise or impact incurred when the extension for stopper 80 is butted to the stopper 82.

Now, the movement of the needle bar 26, made after the latching portion 16 is disengaged and until the needle bar reaches the position corresponding to the upper dead point in the initial stage of the stitch-skipping action, will be described in details referring to FIGS. 8 and 12.

While the carriage 11 is approaching the upper dead point accompanied by the needle bar 26 in the initial stage of the stitch-skipping action, the latching portion 16 is disengaged from the engaging device 27 of the needle bar as described referring to FIGS. 6 to 8. Then the latching portion 16 moves to the position where the latching portion 16 is no longer overlapping the second engaging portion 27*b* of the engaging device 27, as shown in (a) to (b) in FIG. 12. Like replacement for the latching portion 16, the second latching portion 16*b* instead comes to the position under the second engaging portion 27*b*. The needle bar 26 now released from the engagement with the latching portion 16 keeps ascending at the same pace because of the inertia, until the upper face of the first engaging portion 27*a* collides with the positioning block 37, as shown in (c) in FIG. 12. The needle bar 26 attempts to descend, upon being elastically blocked by the positioning block 37, as the reaction of the collision. On the other hand, the second latching portion 16*b* successively reaches the upper dead point after the needle bar 26 as illustrated, and starts to descend as shown in (c) and (d) in FIG. 12. At this moment, the second latching portion 16*b* is located under the first engaging portion 27*a* of the needle bar which is about to descend and sustains the first engaging portion 27*a* as shown in (d) in FIG. 12, thereby inhibiting the reactive movement of the needle bar 26 and immediately stabilizing the needle bar 26 at the position corresponding to the upper dead point.

Thus, even though the needle bar 26 released from the latching portion 16 ascends and collides with the positioning block 37 provided for defining the upper dead point, and then attempts to descend because of the reaction of the collision, the needle bar 26 can be immediately stabilized at the position corresponding to the upper dead point. Accordingly, the latching portion 16 can be accurately and smoothly engaged with the engaging device 27, when the carriage 11 ascends again, after once descending, so as to cause the latching portion 16 to return to the engaging position C to be thereby engaged with the engaging device 27 of the needle bar at the position corresponding to the upper dead point, and therefore the carriage 11 can vertically reciprocate together with the needle bar, thereby enabling performing the sewing work as designed, and thus offering a product having a perfect embroidery pattern.

Operation of returning to the normal sewing work from the stitch-skipping mode will now be described, referring to FIGS. 6 to 8.

As is usually the case, the power to the solenoid 73 is disconnected halfway of the ascending motion of the carriage 11 from the lower dead point toward the upper dead point. Then the rotating arm 77 rotates in the returning direction (arrow 65 in FIG. 7B) driven by the rotating shaft return spring 75 normally provided to the solenoid 73, and also pressed with great force in the direction indicated by the arrow 68, by the resilient force (spring force) abundantly stored in the operating member return spring 85 as described above. Accordingly the operating member 78 can move in the direction of the arrow 66 and quickly return to the position shown in FIG. 6. This allows the latching portion 16 to quickly return to the engaging position C (direction of the arrow 67) with the biasing force applied by the return spring 17 of the latching portion 16, without the interference of the operating member 78. As shown in FIG. 8, when the carriage 11 reaches the upper dead point, the latching portion 16 gets engaged with the engaging device of the needle bar 26, so that the needle bar 26 descends again together with the descending motion of the carriage 11, thus to perform the normal sewing work.

As described above, in the case of skipping the stitch during the normal sewing work, the latching portion 16 can quickly depart from the engaging position C with the engaging device 27 of the needle bar, because the operating member 78 is free from the resistance of the operating member return spring 85 during the initial stage. Also, during the initial stage of returning to the normal sewing work from the stitch-skipping mode, the latching portion 16 at the retreated position S can quickly return to the engaging position C with the engaging device 27 of the needle bar, since the operating member 78 returns driven by the resilient force of the operating member return spring 85 storing therein the surplus energy (rotational force) provided by the solenoid 73.

Such structure that enables the latching portion 16 to quickly move when getting disengaged from the engaging device 27 of the needle bar as well as when getting engaged again allows accurately engaging and disengaging the latching portion 16 and the engaging device 27 of the needle bar even though the needle bar 26 is made to vertically reciprocate faster than ever, and thus increasing the sewing speed and upgrading the sewing work efficiency.

Now, when the latching portion 16 is to return to the engaging position C from the retreated position S, since the operating member 78 can quickly return to the engaging position C utilizing the resilient force stored in the operating member return spring 85 as already described, the spring force of the solenoid rotating shaft return spring 75 may be reduced from the conventional level, or the solenoid rotating shaft return spring 75 itself may be omitted. This allows reducing the cost of the solenoid 73.

Also, as described above, the operating member 78 can quickly return to the engaging position C utilizing the resilient force stored in the operating member return spring 85, and is hence prevented from interfering with the returning movement of the latching portion 16 to the engaging position C. Accordingly, it suffices that the latching portion return spring 17 has such force that enables only the latching portion 16 to return to the engaging position C, which permits reducing the spring force.

The possibility of thus reducing the spring force of the solenoid rotating shaft return spring 75 and the latching portion return spring 17 (or of constituting the solenoid without the built-in solenoid rotating shaft return spring 75) leads to decreased resistance against the driving force of the solenoid 73 when power is supplied to the solenoid 73 for driving, and hence the entirety of the driving force can be allocated for driving the operating member 78 without waste. This permits lowering the capacity (cost) of the solenoid 73. Also, the operating member 78 can be driven so as to disengage the latching portion 16 more quickly from the engaging device 27.

Referring now to FIGS. 9A to 9C, examples of the compression spring that are different from the operating member return spring 85 provided between the operating member 78 and the frame 1 as shown in FIGS. 6 and 7A, 7B will be described.

In FIGS. 9A to 9C, those constituents considered as having the same function, nature or feature as those of the drawings already referred to will be given the same numeral, and the description thereof will not be repeated. (This also applies to the drawings to be subsequently referred to, and the same numerals as those of the foregoing drawings will be given and the description thereof will not be repeated.)

FIGS. 9A to 9C are for explaining the examples in which a two-step spring 88 is employed in place of the operating member return spring 85. The two-step spring 88 is disposed, as shown in FIG. 9A, such that the free end 88*c* thereof is butted to the contact interface 80*a* of the extension for stopper 80, which is unifiedly connected to the operating member 78.

The two-step spring 88 is formed with different spring pitches as illustrated, and includes a loose portion 88*a* where the pitch is coarse and a fortified portion 88*b* where the pitch is dense, and which has greater spring force than the loose portion 88*a*. The respective spring force of the loose portion 88*a* and the fortified portion 88*b* may be determined such that only the loose portion 88*a* is first compressed by the contact interface 80*a* of the extension for stopper 80 in the engagement sector T1 as shown in FIG. 9B, and that the entirety of the two-step spring 88 is compressed in the disengagement sector T2 as shown in FIG. 9C, so that the resilient force can be abundantly stored.

The sewing operation performed with the two-step spring 88 shown in FIGS. 9A to 9C will now be described.

When performing the normal sewing work, the mechanism may be made to work based on the same concept as the description given referring to FIGS. 1 to 8, so as to perform the normal sewing work.

Also, for skipping the stitch during the normal sewing work, the mechanism may be made to work based on the same concept as the description given referring to FIGS. 1 to 8, so as to skip the stitch. In this case, further, the spring force of the two-step spring 88 exerted on the operating member 78 is relatively weak in the engagement sector Ti, and hence substantially no resistance is imposed against the driving force of the solenoid 73 and the entirety of the driving force of the solenoid 73 can be fully utilized to drive the operating member 78. Therefore, the latching portion 16 can be quickly disengaged from the engaging device 27. Also, the surplus driving force of the solenoid 73 (not involved in disengaging the latching portion 16 from the engaging device 27) can be abundantly stored in the two-step spring 88 as resilient force, through the disengagement sector T2.

In the case of returning to the normal sewing work from the stitch-skipping mode, the mechanism may be made to work based on the same concept as the description given referring to FIGS. 1 to 8. In this action, the rotating arm 77 is pressed with great force in the direction of the arrow 68 in FIG. 9C, by the resilient force (spring force) abundantly stored in the two-step spring 88. At this moment, the two-step spring 88 returns to the state shown in FIG. 9A, i.e. the state where the extension for stopper 80 is butted to the stopper 81, because of the abundantly stored resilient force. As a result, the operating member 78 can return more quickly to the state shown in FIG. 9A. Consequently, the latching portion 16 can also quickly return to the engaging position C because of the biasing force applied by the return spring 17 of the latching portion 16, without the interference of the operating member 78.

Referring now to FIGS. 10A to 10C, examples of the compression spring that are different from the operating member return spring 85 provided between the operating member 78 and the frame 1 as shown in FIGS. 6 and 7A, 7B will be described.

FIGS. 10A to 10C are for explaining the examples in which a tensile spring device 89 is employed in place of the operating member return spring 85. In the tensile spring device 89, the numeral 90 designates a pivoting piece attached to the rotating shaft 74 of the solenoid 73, so as to reciprocatively rotate. 90*b* designates a stopper to be engaged with the contact interface 80*a* of the extension for stopper 80 and, as is apparent from FIGS. 10A to 10C, is disposed so as to oppose the contact interface 80*a* across a gap 90*d*. The size of the gap 90*d* is determined such that, as shown in FIG. 10B, the contact interface 80*a* of the extension for stopper 80 is butted to the stopper 90*b* in the vicinity of the position where the latching portion 16 is departing from the engaging device 27, i.e. close to the departing point R 91 designates a known tensile spring, an end portion 91*a* of which is attached to a spring base 92 mounted on the second frame 1*b*, so as to reciprocatively rotate in the direction of the arrow 102. The other end portion 91*b* of the tensile spring 91 is attached to a spring seat 90*c* of the pivoting piece 90.

The sewing operation performed with the tensile spring device 89 shown in FIGS. 10A to 10C will now be described.

For skipping the stitch during the normal sewing work, the mechanism may be made to work based on the same concept as the description given referring to FIGS. 1 to 8, so as to skip the stitch. In this case, further, the operating member 78 is substantially free from the effect of the spring force of the tensile spring device 89 in the engagement sector T1 as shown in FIG. 10B. Accordingly, the entirety of the driving force of the solenoid 73 can be fully utilized to drive the operating member 78, without the interference of the tensile spring 91 of the tensile spring device 89, and hence the latching portion 16 can be quickly moved to the departing point R. Also, the solenoid keeps driving, even after disengaging the latching portion 16 from the engaging device 27 of the needle bar, through the disengagement sector T2 to thereby cause the rotating arm 77 to move in the direction of the arrow 60 in FIG. 10B, until being blocked by the stopper 82 at the position indicated by solid lines in FIG. 10C. Such movement of the operating member 78 driven by the movement of the rotating arm 77 causes the contact interface 80*a* of the extension for stopper 80 to press the pivoting piece 90, so as to rotate in the direction of the arrow 100. The rotation of the pivoting piece 90 stretches the tensile spring 91 in the direction of the arrow 103 in FIG. 10C. The surplus driving force of the solenoid 73 (not involved in disengaging the latching portion 16 from the engaging device 27) can be abundantly stored in the tensile spring 91 of the tensile spring device 89 as resilient force.

In the case of returning to the normal sewing work from the stitch-skipping mode, the mechanism may be made to work based on the same concept as the description given referring to FIGS. 1 to 8. In this action, upon disconnecting the power to the solenoid 73, the rotating arm 77 rotates in the returning direction (arrow 65 in FIG. 10C) because of the rotating shaft return spring 75 normally provided to the solenoid 73, and the pivoting piece 90 rotates with great force in the direction of the arrow 65, because of the resilient force (spring force) abundantly and additionally stored in the tensile spring 91 of the tensile spring device 89. At this moment, the extension for stopper 80 is pressed with great force in the direction of the arrow 68 by the stopper 90*b* of the pivoting piece 90. As a result, the operating member 78 can quickly return to the position shown in FIG. 10A. Consequently, the latching portion 16 can also quickly return to the engaging position C because of the biasing force applied by the return spring 17 of the latching portion 16, without the interference of the operating member 78.

Referring now to FIGS. 11A to 11C, examples of the compression spring that are different from the operating member return spring 85 provided between the operating member 78 and the frame 1 as shown in FIGS. 6 and 7A, 7B will be described. FIGS. 11A to 11C are for explaining the examples in which a known leaf spring 95 is employed in place of the operating member return spring 85.

The leaf spring 95 has its base portion attached to a spring base 96 mounted on the second frame 1*b*. The leaf spring 95 is disposed so as to oppose the contact interface 80*a* of the extension for stopper 80 across a gap 97 formed between the free end 95*a* of the leaf spring 95 and the contact interface 80*a*. The size of the gap 97 is determined such that, as shown in FIG. 11B, the contact interface 80*a* of the extension for stopper 80 is butted to the free end 95*a* of the leaf spring 95 in the vicinity of the position where the latching portion 16 is departing from the engaging device 27, i.e. close to the departing point R.

The sewing operation performed with the leaf spring 95 shown in FIGS. 11A to 11C will now be described.

For skipping the stitch during the normal sewing work, the mechanism may be made to work based on the same concept as the description given referring to FIGS. 1 to 8, so as to skip the stitch. In this case, further, the operating member 78 is substantially free from the effect of the spring force of the leaf spring 95 in the engagement sector T1 as shown in FIG. 11B. Accordingly, the entirety of the driving force of the solenoid 73 can be fully utilized to drive the operating member 78, without the interference of the leaf spring 95, and hence the latching portion 16 can be quickly moved to the departing point R.

Also, the solenoid keeps driving, even after disengaging the latching portion 16 from the engaging device 27 of the needle bar, through the disengagement sector T2 to thereby cause the rotating arm 77 to move in the direction of the arrow 60 in FIG. 11B, until being blocked by the stopper 82 at the position indicated by solid lines in FIG. 11C. Such additional movement of the operating member 78 causes the leaf spring 95 to elastically bend in the direction of the arrow 105. The surplus driving force of the solenoid 73 (not involved in disengaging the latching portion 16 from the engaging device 27) can be abundantly stored in the leaf spring 95 as resilient force.

In the case of returning to the normal sewing work from the stitch-skipping mode, the mechanism may be made to work based on the same concept as the description given referring to FIGS. 1 to 8. In this action, upon disconnecting the power to the solenoid 73, the rotating arm 77 rotates in the returning direction (arrow 65 in FIG. 11C) because of the rotating shaft return spring 75 normally provided to the solenoid 73. Also, the rotating arm 77 is pressed with great force in the direction of the arrow 68, because of the resilient force (spring force)

abundantly and additionally stored in the leaf spring 95. As a result, the operating member 78 can quickly return to the position shown in FIG. 11A. Consequently, the latching portion 16 can also quickly return to the engaging position C because of the biasing force applied by the return spring 17 of the latching portion 16, without the interference of the operating member 78.

As many apparently widely different embodiments of this invention may be made without departing from the spirit and scope thereof, it is to be understood that the invention is not limited to the specific embodiments thereof except as defined in the appended claims.

The invention claimed is:

1. A sewing machine comprising:

a needle bar disposed so as to vertically reciprocate with respect to a frame but constantly biased upward, and having an engaging device provided at an upper portion of the needle bar;

a positioning block that defines an upper dead point of the needle bar; and a carriage to be driven by a main shaft so as to vertically reciprocate in a direction parallel to the needle bar;

the carriage including a latching portion disposed so as to move between an engaging position where the latching portion can be engaged with the engaging device and a retreated position where the latching portion is not engaged with the engaging device;

the latching portion being constantly subjected to a biasing force applied in a direction from the retreated position toward the engaging position, so that the latching portion normally remains engaged with the engaging device of the needle bar to cause the needle bar to vertically reciprocate with vertical reciprocating motion of the carriage;

the sewing machine also comprising a skipping mechanism including a solenoid with a rotating shaft set to reciprocatively rotate and to be driven in one direction when power is supplied to the solenoid; and an operating member radially spaced from the rotating shaft of the solenoid and connected to the rotating shaft of the solenoid, so as to circumferentially rotate with rotation of the rotating shaft of the solenoid;

the operating member being set to be engaged with the latching portion of the carriage when power is supplied to the solenoid thus allowing the latching portion to recede from the engaging position to the retreated position, and to allow the latching portion to return to the engaging position when power to the solenoid is disconnected;

wherein an operating member return spring is provided between the operating member and the frame; and the operating member return spring is formed such that, in a process that upon supplying power to the solenoid the latching portion is being driven from the engaging position to the retreated position, a spring force of the operating member return spring is not, or only weakly exerted on the operating member while the latching portion is located between the engaging position and the vicinity of a departing point where the latching portion starts to be disengaged, and that the spring force is relatively strongly exerted on the operating member while the latching portion is located between the vicinity of the departing point and the retreated position, so that resilient force is stored in the operating member return spring with the movement of the operating member.

2. A sewing machine comprising:

a needle bar disposed so as to vertically reciprocate with respect to a frame but constantly biased upward, and having an engaging device provided at an upper portion;

a positioning block that defines an upper dead point of the needle bar; and a carriage to be driven by a main shaft so as to vertically reciprocate in a direction parallel to the needle bar;

the carriage including a latching portion disposed so as to move between an engaging position where the latching portion can be engaged with the engaging device and a retreated position where the latching portion is not engaged;

the latching portion being constantly subjected to a biasing force applied in a direction from the retreated position toward the engaging position, so that the latching portion normally remains engaged with the engaging device of the needle bar to thereby cause the needle bar to vertically reciprocate with vertical reciprocating motion of the carriage;

the sewing machine also comprising a skipping mechanism including a solenoid with a rotating shaft set to reciprocatively rotate and to be driven in one direction when power is supplied to the solenoid; and an operating member radially spaced from the rotating shaft of the solenoid and connected to the rotating shaft of the solenoid, so as to circumferentially rotate with rotation of the rotating shaft of the solenoid;

the operating member being set to be engaged with the latching portion of the carriage when power is supplied to the solenoid thus allowing the latching portion to recede from the engaging position to the retreated position, and to allow the latching portion to return to the engaging position when power to the solenoid is disconnected;

wherein the engaging device of the needle bar includes a first engaging portion to be located on an upper face of the latching portion when engaged with the latching portion, and a second engaging portion to be located under a lower face of the latching portion;

an extension length of the first engaging portion is longer than that of the second engaging portion;

the latching portion includes a second latching portion located formed lateral to the latching portion so as to interlockedly move with the latching portion; and the second latching portion is located such that the second latching portion lateral to the latching portion comes to a position under the first engaging portion so as to sustain the engaging device thereby inhibiting the needle bar from descending farther, when the latching portion is moved, while the needle bar is ascending, from the engaging position toward the retreated position until passing over the departing point, thereby causing the needle bar to keep ascending because of inertia until the engaging device of the needle bar collides with the positioning block at the upper dead point, and to start descending because of reaction from the collision.

3. A sewing machine comprising:

a needle bar disposed so as to vertically reciprocate with respect to a frame but constantly biased upward, and having an engaging device provided at an upper portion;

a positioning block that defines an upper dead point of the needle bar; and a carriage to be driven by a main shaft so as to vertically reciprocate in a direction parallel to the needle bar;

the carriage including a latching portion disposed so as to move between an engaging position where the latching portion can be engaged with the engaging device and a retreated position where the latching portion is not engaged;

the latching portion being constantly subjected to a biasing force applied in a direction from the retreated position toward the engaging position, so that the latching portion normally remains engaged with the engaging device of the needle bar to thereby cause the needle bar to vertically reciprocate with vertical reciprocating motion of the carriage;

the sewing machine also comprising a skipping mechanism including a solenoid with a rotating shaft set to reciprocatively rotate and to be driven in one direction when power is supplied to the solenoid; and an operating member radially spaced from the rotating shaft of the solenoid and connected to the rotating shaft of the solenoid, so as to circumferentially rotate with rotation of the rotating shaft of the solenoid;

the operating member being set to be engaged with the latching portion of the carriage when power is supplied to the solenoid thus allowing the latching portion to recede from the engaging position to the retreated position, and to allow the latching portion to return to the engaging position when power to the solenoid is disconnected;

wherein an operating member return spring is provided between the operating member and the frame;

the operating member return spring is formed such that, in a process that upon supplying power to the solenoid the latching portion is being driven from the engaging position to the retreated position, a spring force of the operating member return spring is not, or only weakly exerted on the operating member while the latching portion is located between the engaging position and the vicinity of a departing point where the latching portion starts to be disengaged, and that the spring force is relatively strongly exerted on the operating member while the latching portion is located between the vicinity of the departing point and the retreated position, so that resilient force is stored in the operating member return spring with the movement of the operating member;

the engaging device of the needle bar includes a first engaging portion to be located on an upper face of the latching portion when engaged with the latching portion, and a second engaging portion to be located under a lower face of the latching portion;

an extension length of the first engaging portion is longer than that of the second engaging portion;

the latching portion includes a second latching portion located formed lateral to the latching portion so as to interlockedly move with the latching portion; and the second latching portion is located such that the second latching portion lateral to the latching portion comes to a position under the first engaging portion so as to sustain the engaging device thereby inhibiting the needle bar from descending farther, when the latching portion is moved, while the needle bar is ascending, from the engaging position toward the retreated position until passing over the departing point, thereby causing the needle bar to keep ascending because of inertia until the engaging device of the needle bar collides with the positioning block at the upper dead point, and to start descending because of reaction from the collision.

* * * * *